US007537216B2

(12) United States Patent
Soltys et al.

(10) Patent No.: US 7,537,216 B2
(45) Date of Patent: May 26, 2009

(54) METHOD, APPARATUS AND ARTICLE FOR COMPUTATIONAL SEQUENCE GENERATION AND PLAYING CARD DISTRIBUTION

(75) Inventors: Richard Soltys, Mercer Island, WA (US); Richard Huizinga, Mercer Island, WA (US)

(73) Assignee: ARL, Inc., Mercer Island, WA (US)

( * ) Notice: Subject to any disclaimer, the term of this patent is extended or adjusted under 35 U.S.C. 154(b) by 512 days.

(21) Appl. No.: 10/962,166

(22) Filed: Oct. 8, 2004

(65) Prior Publication Data

US 2005/0110210 A1 May 26, 2005

Related U.S. Application Data

(60) Provisional application No. 60/509,802, filed on Oct. 8, 2003, provisional application No. 60/543,856, filed on Feb. 10, 2004.

(51) Int. Cl.

| | |
|---|---|
| ***A63B 71/00*** | (2006.01) |
| ***A63F 9/00*** | (2006.01) |
| ***A63F 1/14*** | (2006.01) |
| ***A63F 1/12*** | (2006.01) |
| ***G06F 1/02*** | (2006.01) |
| ***G06F 7/58*** | (2006.01) |

(52) U.S. Cl. ..... 273/149 P; 273/149 R; 273/148 R; 273/309; 708/250

(58) Field of Classification Search ..... 708/250; 273/309, 148 R, 149 R, 149 P See application file for complete search history.

(56) References Cited

U.S. PATENT DOCUMENTS

| | | | | |
|---|---|---|---|---|
| 1,034,402 | A | 7/1912 | Hardy | |
| 1,727,800 | A | 9/1929 | Albert | |
| 1,890,504 | A | 12/1932 | Ferguson, Jr. | |
| 2,663,418 | A | 12/1953 | Grunwald | 206/62 |
| 2,694,662 | A | 11/1954 | Hunter, Jr. | 154/121 |
| 3,222,071 | A | 12/1965 | Lang | 273/149 |
| 3,312,473 | A | 4/1967 | Friedman et al. | 273/149 |
| 3,377,070 | A | 4/1968 | Nottoli | 273/149 |
| 3,667,759 | A | 6/1972 | Barr | 273/152.1 |
| 3,690,670 | A | 9/1972 | Cassady et al. | 273/149 P |

(Continued)

FOREIGN PATENT DOCUMENTS

DE 44 39 502 C1 9/1995

(Continued)

OTHER PUBLICATIONS

U.S. Appl. No. 11/558,409, filed Nov. 9, 2006, Soltys.

(Continued)

*Primary Examiner*—John M Hotaling, II
*Assistant Examiner*—Kevin Y Kim
(74) *Attorney, Agent, or Firm*—Seed IP Law Group PLLC

(57) ABSTRACT

A computationally generated playing card sequence (e.g., pseudo-random, non pseudo-random, or partially pseudo-random) allows shuffled distribution of playing cards. Playing cards may be organized into card holders by at least one or a rank and a suit, and retrieved in the computationally generated order. Alternatively, playing cards may be organized into card holders in order of a computationally generated sequence, and retrieve as necessary. Unreadable playing cards may be automatically removed from play.

40 Claims, 23 Drawing Sheets

U.S. PATENT DOCUMENTS

| | | | | | |
|---|---|---|---|---|---|
| 3,751,041 | A | | 8/1973 | Seifert | 273/149 P |
| 3,766,452 | A | | 10/1973 | Burpee et al. | 317/262 R |
| 3,814,436 | A | | 6/1974 | Boren | 273/149 P |
| 3,897,954 | A | | 8/1975 | Erickson et al. | 273/149 R |
| 3,929,339 | A | | 12/1975 | Mattioli | 273/148 A |
| 4,031,376 | A | | 6/1977 | Corkin, Jr. | 235/156 |
| 4,241,921 | A | | 12/1980 | Miller | 273/148 A |
| 4,244,582 | A | | 1/1981 | Raees et al. | 273/293 |
| 4,310,160 | A | | 1/1982 | Willette et al. | 273/149 R |
| 4,373,726 | A | | 2/1983 | Churchill et al. | 273/138 A |
| 4,377,285 | A | | 3/1983 | Kadlic | 273/148 A |
| 4,448,419 | A | | 5/1984 | Telnaes | 273/143 R |
| 4,497,488 | A | | 2/1985 | Plevyak et al. | 273/149 R |
| 4,531,187 | A | | 7/1985 | Uhland | 364/412 |
| 4,534,562 | A | | 8/1985 | Cuff et al. | 273/149 P |
| 4,586,712 | A | | 5/1986 | Lorber et al. | 273/149 R |
| 4,636,846 | A | | 1/1987 | Villarreal | 358/100 |
| 4,659,082 | A | | 4/1987 | Greenberg | 273/149 R |
| 4,662,637 | A | | 5/1987 | Pfeiffer | 273/149 P |
| 4,667,959 | A | | 5/1987 | Pfeiffer et al. | 273/149 R |
| 4,693,480 | A | | 9/1987 | Smith | 273/296 |
| 4,725,079 | A | | 2/1988 | Koza et al. | 283/73 |
| 4,728,108 | A | | 3/1988 | Neuwahl | 273/296 |
| 4,750,743 | A | | 6/1988 | Nicoletti | 273/148 A |
| 4,770,421 | A | * | 9/1988 | Hoffman | 273/149 R |
| 4,807,884 | A | | 2/1989 | Breeding | 273/149 R |
| 4,814,589 | A | | 3/1989 | Storch et al. | 235/375 |
| 4,817,528 | A | | 4/1989 | Baker | 101/395 |
| 4,822,050 | A | | 4/1989 | Normand et al. | 273/149 P |
| 4,832,341 | A | | 5/1989 | Muller et al. | 273/139 |
| 4,832,342 | A | | 5/1989 | Plevyak et al. | 273/149 R |
| 4,885,700 | A | | 12/1989 | Kondziolka et al. | 364/519 |
| 4,951,950 | A | | 8/1990 | Normand et al. | 273/149 P |
| 4,969,648 | A | | 11/1990 | Hollinger et al. | 273/149 R |
| 4,995,615 | A | | 2/1991 | Cheng | 273/292 |
| 4,998,737 | A | | 3/1991 | Lamle | 273/296 |
| 5,000,453 | A | | 3/1991 | Stevens et al. | 273/149 R |
| 5,039,102 | A | | 8/1991 | Miller | 273/148 R |
| 5,053,612 | A | | 10/1991 | Pielemeier et al. | 235/462 |
| 5,067,713 | A | | 11/1991 | Soules et al. | 273/149 P |
| 5,096,197 | A | | 3/1992 | Embury | 273/149 R |
| 5,110,134 | A | | 5/1992 | Laughlin et al. | 273/293 |
| 5,114,153 | A | | 5/1992 | Rosenwinkel et al. | 273/292 |
| 5,121,921 | A | | 6/1992 | Friedman et al. | 273/149 P |
| 5,179,517 | A | | 1/1993 | Sarbin et al. | 364/410 |
| 5,186,464 | A | | 2/1993 | Lamle | 273/149 R |
| 5,199,710 | A | * | 4/1993 | Lamle | 463/22 |
| 5,224,712 | A | | 7/1993 | Laughlin et al. | 273/304 |
| 5,240,140 | A | | 8/1993 | Huen | 221/13 |
| 5,259,907 | A | | 11/1993 | Soules et al. | 156/277 |
| 5,261,667 | A | | 11/1993 | Breeding | 273/149 R |
| 5,275,411 | A | | 1/1994 | Breeding | 273/149 R |
| 5,283,422 | A | | 2/1994 | Storch et al. | 235/375 |
| 5,303,921 | A | | 4/1994 | Breeding | 273/149 R |
| 5,312,104 | A | | 5/1994 | Miller | 273/148 R |
| 5,344,146 | A | | 9/1994 | Lee | 273/149 R |
| 5,356,145 | A | | 10/1994 | Verschoor | 273/149 R |
| 5,362,053 | A | | 11/1994 | Miller | 273/148 R |
| 5,374,061 | A | | 12/1994 | Albrecht | 273/149 R |
| 5,382,024 | A | | 1/1995 | Blaha | 273/149 R |
| 5,397,133 | A | | 3/1995 | Penzias | 273/439 |
| 5,416,308 | A | | 5/1995 | Hood et al. | 235/454 |
| 5,417,431 | A | | 5/1995 | Gluck | 273/293 |
| 5,431,399 | A | * | 7/1995 | Kelley | 273/149 P |
| 5,445,377 | A | | 8/1995 | Steinbach | 273/149 R |
| 5,511,784 | A | | 4/1996 | Furry et al. | 273/143 R |
| 5,518,249 | A | | 5/1996 | Sines et al. | 273/304 |
| 5,575,475 | A | | 11/1996 | Steinbach | 273/149 R |
| 5,584,483 | A | | 12/1996 | Sines et al. | 273/149 R |
| 5,605,334 | A | | 2/1997 | McCrea, Jr. | 273/309 |
| 5,613,680 | A | | 3/1997 | Groves et al. | 273/138.2 |
| 5,632,483 | A | | 5/1997 | Garczynski et al. | 273/148 R |
| 5,651,548 | A | | 7/1997 | French et al. | 273/309 |
| 5,654,050 | A | | 8/1997 | Whalen-Shaw | 428/35.7 |
| 5,655,961 | A | | 8/1997 | Acres et al. | 463/27 |
| 5,669,816 | A | | 9/1997 | Garczynski et al. | 463/12 |
| 5,676,372 | A | | 10/1997 | Sines et al. | 273/149 R |
| 5,681,039 | A | | 10/1997 | Miller | 273/148 R |
| 5,683,085 | A | | 11/1997 | Johnson et al. | 273/149 R |
| 5,685,543 | A | | 11/1997 | Garner | 273/148 A |
| 5,692,748 | A | | 12/1997 | Frisco et al. | 273/149 R |
| 5,695,189 | A | | 12/1997 | Breeding et al. | 273/149 R |
| 5,698,839 | A | | 12/1997 | Jagielinski et al. | 235/493 |
| 5,707,287 | A | | 1/1998 | McCrea, Jr. | 463/27 |
| 5,711,525 | A | | 1/1998 | Breeding | 273/292 |
| 5,718,427 | A | | 2/1998 | Cranford et al. | 273/149 R |
| 5,722,893 | A | | 3/1998 | Hill et al. | 463/47 |
| 5,735,525 | A | | 4/1998 | McCrea, Jr. | 273/309 |
| 5,766,074 | A | | 6/1998 | Cannon et al. | 463/16 |
| 5,769,458 | A | | 6/1998 | Carides et al. | 283/102 |
| 5,770,533 | A | | 6/1998 | Franchi | 463/42 |
| 5,772,505 | A | | 6/1998 | Garczynski et al. | 463/12 |
| 5,779,545 | A | | 7/1998 | Berg et al. | 463/22 |
| 5,779,546 | A | | 7/1998 | Meissner et al. | 463/25 |
| 5,788,573 | A | | 8/1998 | Baerlocher et al. | 463/16 |
| 5,791,988 | A | | 8/1998 | Nomi | 463/11 |
| 5,803,808 | A | | 9/1998 | Strisower | 463/11 |
| 5,803,809 | A | | 9/1998 | Yoseloff | 463/13 |
| 5,830,064 | A | | 11/1998 | Bradish et al. | 463/22 |
| 5,842,921 | A | | 12/1998 | Mindes et al. | 463/16 |
| 5,863,249 | A | | 1/1999 | Inoue | 463/20 |
| 5,871,400 | A | | 2/1999 | Yfantis | 463/22 |
| 5,895,048 | A | | 4/1999 | Smith, Jr. | 273/293 |
| 5,911,626 | A | | 6/1999 | McCrea, Jr. | 463/27 |
| 5,919,091 | A | | 7/1999 | Bell et al. | 463/25 |
| 5,941,769 | A | | 8/1999 | Order | 463/12 |
| 5,944,310 | A | | 8/1999 | Johnson et al. | 273/149 R |
| 5,945,654 | A | | 8/1999 | Huang | 235/449 |
| 5,949,050 | A | | 9/1999 | Fosbenner et al. | 235/449 |
| 5,954,654 | A | | 9/1999 | Eaton et al. | 600/462 |
| 5,967,893 | A | | 10/1999 | Lawrence et al. | 463/10 |
| 5,989,122 | A | | 11/1999 | Roblejo | 463/22 |
| 6,010,404 | A | | 1/2000 | Walker et al. | 463/21 |
| 6,019,368 | A | | 2/2000 | Sines et al. | 273/149 R |
| 6,021,949 | A | | 2/2000 | Boiron | 235/492 |
| 6,039,650 | A | | 3/2000 | Hill | 463/47 |
| 6,042,150 | A | | 3/2000 | Daley | 283/86 |
| 6,062,981 | A | | 5/2000 | Luciano, Jr. | 463/26 |
| 6,068,258 | A | | 5/2000 | Breeding et al. | 273/149 R |
| 6,068,552 | A | | 5/2000 | Walker et al. | 463/21 |
| 6,093,103 | A | | 7/2000 | McCrea, Jr. | 463/27 |
| 6,104,815 | A | | 8/2000 | Alcorn et al. | 380/251 |
| 6,117,009 | A | | 9/2000 | Yoseloff | 463/20 |
| 6,117,012 | A | | 9/2000 | McCrea, Jr. | 463/27 |
| 6,126,166 | A | | 10/2000 | Lorson et al. | 273/148 R |
| 6,139,014 | A | | 10/2000 | Breeding et al. | 273/149 R |
| 6,142,876 | A | | 11/2000 | Cumbers | 463/25 |
| 6,145,838 | A | | 11/2000 | White | 273/295 |
| 6,149,154 | A | | 11/2000 | Grauzer et al. | 273/149 R |
| 6,152,822 | A | | 11/2000 | Herbert | 463/22 |
| 6,154,131 | A | | 11/2000 | Jones, II et al. | 340/540 |
| 6,159,096 | A | | 12/2000 | Yoseloff | 463/20 |
| 6,166,763 | A | | 12/2000 | Rhodes et al. | 348/143 |
| 6,186,892 | B1 | | 2/2001 | Frank et al. | 463/19 |
| 6,193,607 | B1 | | 2/2001 | Kay | 463/22 |
| 6,196,547 | B1 | | 3/2001 | Pascal et al. | 273/292 |
| 6,217,447 | B1 | | 4/2001 | Lofink et al. | 463/12 |
| 6,234,898 | B1 | | 5/2001 | Belamant et al. | 463/25 |
| 6,250,632 | B1 | * | 6/2001 | Albrecht | 273/149 R |
| 6,254,096 | B1 | | 7/2001 | Grauzer et al. | 273/149 R |
| 6,254,484 | B1 | | 7/2001 | McCrea, Jr. | 463/27 |
| 6,267,248 | B1 | | 7/2001 | Johnson et al. | 209/547 |
| 6,267,671 | B1 | | 7/2001 | Hogan | 463/25 |
| 6,293,546 | B1 | | 9/2001 | Hessing et al. | 273/138.2 |

| | | | | |
|---|---|---|---|---|
| 6,293,864 | B1 | 9/2001 | Romero | 463/12 |
| 6,299,167 | B1 | 10/2001 | Sines et al. | 273/149 R |
| 6,299,170 | B1 | 10/2001 | Yoseloff | 273/292 |
| 6,299,536 | B1 | 10/2001 | Hill | 463/47 |
| 6,312,334 | B1 | 11/2001 | Yoseloff | 463/25 |
| 6,313,871 | B1 | 11/2001 | Schubert | 348/143 |
| 6,315,664 | B1 | 11/2001 | Baerlocher et al. | 463/21 |
| 6,325,373 | B1 | 12/2001 | Breeding et al. | 273/149 R |
| 6,346,044 | B1 | 2/2002 | McCrea, Jr. | 463/27 |
| 6,357,746 | B1 | 3/2002 | Sadowski | 273/148 R |
| 6,361,044 | B1 | 3/2002 | Block et al. | 273/149 R |
| 6,371,482 | B1 | 4/2002 | Hall, Jr. | 273/138.1 |
| 6,386,973 | B1 | 5/2002 | Yoseloff | 463/13 |
| 6,394,902 | B1 | 5/2002 | Glavich | 463/20 |
| 6,402,142 | B1 | 6/2002 | Warren et al. | 273/149 R |
| 6,403,908 | B2 * | 6/2002 | Stardust et al. | 209/587 |
| 6,406,023 | B1 | 6/2002 | Rowe | 273/292 |
| 6,406,369 | B1 | 6/2002 | Baerlocher et al. | 463/20 |
| 6,409,595 | B1 | 6/2002 | Uihlein et al. | 463/29 |
| 6,413,162 | B1 | 7/2002 | Baerlocher et al. | 463/20 |
| 6,425,824 | B1 | 7/2002 | Baerlocher et al. | 463/16 |
| 6,446,864 | B1 | 9/2002 | Kim et al. | 235/382 |
| 6,457,715 | B1 | 10/2002 | Friedman | 273/274 |
| 6,460,848 | B1 | 10/2002 | Soltys et al. | 273/149 R |
| 6,464,581 | B1 | 10/2002 | Yoseloff | 463/20 |
| 6,468,156 | B1 | 10/2002 | Hughs-Baird et al. | 463/25 |
| 6,471,208 | B2 | 10/2002 | Yoseloff et al. | 273/143 R |
| 6,485,366 | B1 | 11/2002 | Rowe | 463/13 |
| 6,502,116 | B1 | 12/2002 | Kelly et al. | 708/250 |
| 6,508,709 | B1 | 1/2003 | Karmarkar | 463/42 |
| 6,508,710 | B1 | 1/2003 | Paravia et al. | 463/42 |
| 6,514,140 | B1 | 2/2003 | Storch | 463/25 |
| 6,517,435 | B2 | 2/2003 | Soltys et al. | 463/25 |
| 6,517,436 | B2 | 2/2003 | Soltys et al. | 463/29 |
| 6,517,437 | B1 | 2/2003 | Wells et al. | 463/30 |
| 6,520,857 | B2 | 2/2003 | Soltys et al. | 463/29 |
| 6,527,271 | B2 | 3/2003 | Soltys et al. | 273/148 R |
| 6,530,836 | B2 | 3/2003 | Soltys et al. | 463/29 |
| 6,530,837 | B2 | 3/2003 | Soltys et al. | 463/29 |
| 6,533,276 | B2 | 3/2003 | Soltys et al. | 273/148 R |
| 6,533,662 | B2 | 3/2003 | Soltys et al. | 463/25 |
| 6,533,664 | B1 | 3/2003 | Crumby | 463/42 |
| 6,543,770 | B1 | 4/2003 | Kaji et al. | 273/148 R |
| 6,561,897 | B1 | 5/2003 | Bourbour et al. | 463/13 |
| 6,568,678 | B2 | 5/2003 | Breeding et al. | 273/149 R |
| 6,579,180 | B2 | 6/2003 | Soltys et al. | 463/25 |
| 6,579,181 | B2 | 6/2003 | Soltys et al. | 463/25 |
| 6,581,747 | B1 | 6/2003 | Charlier et al. | 194/214 |
| 6,582,301 | B2 | 6/2003 | Hill | 463/11 |
| 6,588,750 | B1 | 7/2003 | Grauzer et al. | 273/149 R |
| 6,588,751 | B1 | 7/2003 | Grauzer et al. | 273/149 R |
| 6,595,857 | B2 | 7/2003 | Soltys et al. | 463/29 |
| 6,599,185 | B1 | 7/2003 | Kaminkow et al. | 463/16 |
| 6,629,591 | B1 | 10/2003 | Griswold et al. | 194/205 |
| 6,629,889 | B2 | 10/2003 | Mothwurf | 463/25 |
| 6,638,161 | B2 | 10/2003 | Soltys et al. | 463/12 |
| 6,651,981 | B2 | 11/2003 | Grauzer et al. | 273/149 R |
| 6,651,982 | B2 | 11/2003 | Grauzer et al. | 273/149 R |
| 6,652,379 | B2 | 11/2003 | Soltys et al. | 463/22 |
| 6,655,684 | B2 | 12/2003 | Grauzer et al. | 273/149 R |
| 6,659,460 | B2 | 12/2003 | Blaha et al. | 273/149 R |
| 6,663,490 | B2 | 12/2003 | Soltys et al. | 463/25 |
| 6,676,127 | B2 | 1/2004 | Johnson et al. | 273/149 R |
| 6,676,516 | B2 | 1/2004 | Baerlocher et al. | 463/25 |
| 6,685,568 | B2 | 2/2004 | Soltys et al. | 463/47 |
| 6,688,979 | B2 | 2/2004 | Soltys et al. | 463/25 |
| 6,698,756 | B1 | 3/2004 | Baker et al. | 273/149 R |
| 6,698,759 | B2 | 3/2004 | Webb et al. | 273/292 |
| 6,712,693 | B1 | 3/2004 | Hettinger | 463/20 |
| 6,712,696 | B2 | 3/2004 | Soltys et al. | 463/25 |
| 6,719,288 | B2 | 4/2004 | Hessing et al. | 273/149 R |
| 6,726,205 | B1 * | 4/2004 | Purton | 273/148 R |
| 6,728,740 | B2 | 4/2004 | Kelly et al. | 708/250 |
| 6,729,956 | B2 | 5/2004 | Wolf et al. | 463/25 |
| 6,729,961 | B1 | 5/2004 | Millerschone | 463/30 |
| 6,736,250 | B2 | 5/2004 | Mattice | 194/203 |
| 6,745,330 | B1 | 6/2004 | Maillot | 713/200 |
| 6,758,751 | B2 | 7/2004 | Soltys et al. | 463/29 |
| 6,817,948 | B2 | 11/2004 | Pascal et al. | 463/42 |
| 6,857,961 | B2 | 2/2005 | Soltys et al. | 463/47 |
| 6,889,979 | B2 | 5/2005 | Blaha et al. | 273/149 R |
| 6,896,618 | B2 | 5/2005 | Benoy et al. | 463/25 |
| 6,923,719 | B2 | 8/2005 | Wolf | 463/16 |
| 6,955,599 | B2 | 10/2005 | Bourbour et al. | 463/13 |
| 6,964,612 | B2 | 11/2005 | Soltys et al. | 463/47 |
| 6,991,544 | B2 | 1/2006 | Soltys et al. | 463/42 |
| 7,011,309 | B2 | 3/2006 | Soltys et al. | 273/149 R |
| 7,029,009 | B2 | 4/2006 | Grauzer et al. | 273/149 P |
| 7,073,791 | B2 | 7/2006 | Grauzer et al. | 273/149 R |
| 2002/0017481 | A1 * | 2/2002 | Johnson et al. | 209/547 |
| 2002/0063389 | A1 | 5/2002 | Breeding et al. | 273/292 |
| 2002/0147042 | A1 | 10/2002 | Vuong et al. | 463/40 |
| 2002/0163125 | A1 | 11/2002 | Grauzer et al. | 273/149 R |
| 2002/0187821 | A1 | 12/2002 | Soltys et al. | 463/11 |
| 2003/0032474 | A1 | 2/2003 | Kaminkow | 463/25 |
| 2003/0036425 | A1 | 2/2003 | Kaminkow et al. | 463/25 |
| 2003/0073498 | A1 | 4/2003 | Grauzer et al. | 463/42 |
| 2003/0083126 | A1 | 5/2003 | Paulsen | 463/25 |
| 2003/0087701 | A1 | 5/2003 | Paravia et al. | 463/42 |
| 2003/0090059 | A1 * | 5/2003 | Grauzer et al. | 273/149 R |
| 2003/0176209 | A1 | 9/2003 | Soltys et al. | 463/13 |
| 2003/0195037 | A1 | 10/2003 | Vuong et al. | 463/29 |
| 2004/0067789 | A1 | 4/2004 | Grauzer et al. | 463/11 |
| 2004/0100026 | A1 | 5/2004 | Haggard | 273/304 |
| 2004/0108255 | A1 | 6/2004 | Johnson | 209/547 |
| 2004/0108654 | A1 | 6/2004 | Grauzer et al. | 273/148 R |
| 2004/0169332 | A1 | 9/2004 | Grauzer et al. | 273/149 R |
| 2004/0207156 | A1 | 10/2004 | Soltys et al. | 273/292 |
| 2004/0224777 | A1 | 11/2004 | Smith et al. | 463/47 |
| 2004/0229682 | A1 | 11/2004 | Gelinotte | 463/25 |
| 2005/0012270 | A1 | 1/2005 | Schubert et al. | 273/149 R |
| 2005/0023752 | A1 | 2/2005 | Grauzer et al. | 273/149 R |
| 2005/0026680 | A1 | 2/2005 | Gururajan | 463/25 |
| 2005/0026681 | A1 | 2/2005 | Grauzer et al. | 463/29 |
| 2005/0026682 | A1 | 2/2005 | Grauzer et al. | 463/29 |
| 2005/0040594 | A1 | 2/2005 | Krenn et al. | 273/149 R |
| 2005/0051955 | A1 | 3/2005 | Schubert et al. | 273/149 R |
| 2005/0051965 | A1 | 3/2005 | Gururajan | 273/292 |
| 2005/0054408 | A1 | 3/2005 | Steil et al. | 463/11 |
| 2005/0062226 | A1 | 3/2005 | Schubert et al. | 273/149 R |
| 2005/0062227 | A1 | 3/2005 | Grauzer et al. | 273/149 R |
| 2005/0073102 | A1 | 4/2005 | Yoseloff et al. | 273/292 |
| 2005/0093230 | A1 | 5/2005 | Grauzer et al. | 273/149 R |
| 2005/0101367 | A1 | 5/2005 | Soltys et al. | 463/12 |
| 2005/0121852 | A1 | 6/2005 | Soltys et al. | 273/149 P |
| 2005/0137005 | A1 | 6/2005 | Soltys et al. | 463/13 |
| 2005/0156318 | A1 | 7/2005 | Douglas | 257/761 |
| 2005/0164761 | A1 | 7/2005 | Tain | 463/13 |
| 2005/0288083 | A1 | 12/2005 | Downs, III | 463/11 |
| 2005/0288084 | A1 | 12/2005 | Schubert | 463/11 |
| 2005/0288085 | A1 | 12/2005 | Schubert et al. | 463/11 |
| 2006/0001217 | A1 | 1/2006 | Soltys et al. | 273/292 |
| 2006/0019745 | A1 | 1/2006 | Benbrahim | 463/29 |

FOREIGN PATENT DOCUMENTS

| | | | |
|---|---|---|---|
| DE | 197 48 930 | A1 | 5/1998 |
| EP | 0 327 069 | A2 | 8/1989 |
| EP | 0 790 848 | | 8/1997 |
| EP | 1 291 045 | A2 | 3/2003 |
| FR | 2 775 196 | | 8/1999 |
| GB | 2 246 520 | A | 2/1992 |
| GB | 2 370 791 | A | 7/2002 |
| GB | 2 380 143 | A | 4/2003 |
| GB | 2 382 034 | A | 5/2003 |
| WO | WO 96/36253 | | 11/1996 |

| | | | |
|---|---|---|---|
| WO | WO 99/43403 | | 9/1999 |
| WO | WO 02/05914 | A1 | 1/2002 |
| WO | WO 02/051512 | A2 | 7/2002 |
| WO | WO 03/004116 | A1 | 1/2003 |
| WO | WO 03/060846 | A2 | 7/2003 |
| WO | WO 2006/039308 | A2 | 4/2006 |

OTHER PUBLICATIONS

English Translation of German Patent No. DE 197 48 930, publication dated of May 14, 1998, inventor: Markeev.
U.S. Appl. No. 10/885,875, filed Jul. 7, 2004, Soltys et al.
U.S. Appl. No. 10/902,436, filed Jul. 29, 2004, Soltys et al.
U.S. Appl. No. 11/059,743, filed Feb. 16, 2005, Soltys et al.
U.S. Appl. No. 11/112,793, filed Apr. 21, 2005, Soltys et al.
U.S. Appl. No. 11/337,375, filed Jan. 23, 2006, Soltys et al.
U.S. Appl. No. 11/352,416, filed Feb. 10, 2006, Soltys.
U.S. Appl. No. 11/428,240, filed Jun. 30, 2006, Fleckenstein.
U.S. Appl. No. 11/428,244, filed Jun. 30, 2006, Soltys.
U.S. Appl. No. 11/428,249, filed Jun. 30, 2006, Fleckenstein.
U.S. Appl. No. 11/428,253, filed Jun. 30, 2006, Fleckenstein.
U.S. Appl. No. 11/428,258, filed Jun. 30, 2006, Fleckenstein.
U.S. Appl. No. 11/428,264, filed Jun. 30, 2006, Soltys.
U.S. Appl. No. 11/428,286, filed Jun. 30, 2006, Soltys et al.
U.S. Appl. No. 11/437,590, filed May 19, 2006, Soltys et al.
U.S. Appl. No. 11/478,360, filed Jun. 29, 2006, Fleckenstein.
U.S. Appl. No. 11/479,930, filed Jun. 30, 2006, Soltys et al.
U.S. Appl. No. 11/479,963, filed Jun. 29, 2006, Fleckenstein.
U.S. Appl. No. 11/479,991, filed Jun. 29, 2006, Soltys.
U.S. Appl. No. 11/480,273, filed Jun. 30, 2006, Soltys.
U.S. Appl. No. 11/480,275, filed Jun. 30, 2006, Fleckenstein.
U.S. Appl. No. 11/480,295, filed Jun. 29, 2006, Fleckenstein.
U.S. Appl. No. 11/480,321, filed Jun. 30, 2006, Soltys.
U.S. Appl. No. 11/480,345, filed Jun. 30, 2006, Fleckenstein.
U.S. Appl. No. 11/480,349, filed Jun. 30, 2006, Soltys et al.
U.S. Appl. No. 11/519,244, filed Sep. 11, 2006, Soltys et al.
U.S. Appl. No. 60/838,280, filed Aug. 17, 2006, Soltys et al.
Bulavsky, J., "Tracking the Tables," *Casino Journal*, May 2004, pp. 44-47, accessed Dec. 21, 2005, URL=http://www.ascendgaming.com/cj/vendors_manufacturers_table/Trackin916200411141AM.htm, 5 pages.
Burke, A., "Tracking the Tables," reprinted from *International Gaming & Wagering Business*, Aug. 2003, 4 pages.
Griffin, P., *The Theory of Blackjack*, GBC Press, Las Vegas, Nevada, 1979, 190 pages.
Gros, R., "All You Ever Wanted to Know About Table Games," reprinted from *Global Gaming Business*, Aug. 1, 2003, 2 pages.
Pro, L.V., "Book Review—The Card Counter's Guide to Casino Surveillance," *Blackjack Insider Newsletter*, May 2003, #40, accessed Aug. 25, 2006, URL=http:/bjinsider.com/newsletter_40_surveillance.shtml, 5 pages.
Scarne, J., *Scarne's Encyclopedia of Games*, Harper & Row, New York, 1973, p. 153.
Scarne, J., *Scarne's New Complete Guide to Gambling*, Simon & Schuster, Inc., New York, 1974, pp. 358-359.
Snyder, A., "The High-Tech Eye," excerpt from *Blackjack Forum*, Spring 1997, accessed Dec. 21, 2005, from Casino Software & Services, LLC, URL=http://www.casinosoftware.com/bj_forum.html.
Terdiman, D., "Who's Holding the Aces Now?", reprinted from *Wired News*, Aug. 18, 2003, 2 pages.
Ward, K., "BJ Tracking System has Players Down for the Count," *Gaming Today*, Mar. 5, 2002, accessed Dec. 21, 2005, from Casino Software & Services, LLC, URL=http://www.casinosoftware.com/gaming_today.html.
Winkler, C., "Product Spotlight: MindPlay," reprinted from *Gaming and Leisure Technology*, Fall 2003, 2 pages.
Bally TMS, "MP21—Automated Table Tracking/Features," 2 pages, Nov. 2005.
Bally TMS, "MPBacc—Intelligent Table Tracking/Features," 2 pages, Nov. 2005.
Bally TMS, "MPBacc—Specifications/Specifications," 2 pages, Nov. 2005.
Bravo Gaming Systems, "Casino Table Wager Analysis and Player Tracking System—Table Operations/Unique Features," accessed Apr. 11, 2005, URL=http://www.genesisgaming.com, 4 pages.
Casino Software & Services, LLC., accessed Aug. 25, 2006, URL=http:/casinosoftware.com/home.html, 6 pages.
International Guild of Hospitality & Restaurant Managers, "Shuffle Master, Inc. (NasdaqNM:SHFL)," accessed Dec. 30, 2003, URL=http://hospitalityguide.com/Financial/Casinos/Shuffle.htm, 3 pages.
Mikohn, "Mikohn Tablelink—The Industry's Premier Table Tracking Solution Delivers Improvements Straight to the Bottom Line," 2 pages, before Jan. 1, 2004.
Mikohn, "Tablelink™, The New Standard in Table Games," before Jan. 1, 2004, 14 pages.
Shuffle Master, Inc., "Shuffle Master Announces New Products; Intelligent Table System to Be Debuted at G2E," Sep. 10, 2003, 2 pages.
Shuffle Master, Inc., "Shuffle Master Gaming Presents The Ultimate Player Rating System . . . Bloodhound Sniffs Out the Pros and Cons," Dec. 31, 1997, 6 pages.
Plaintiff's Declaration of Lawrence Luciano in Opposition to Shuffle Master's Motion for Preliminary Injunction, Card, LLC v. Shuffle Master, Inc., D. Nev. (No. CV-N-03-0244-ECR-(RAM)), Nov. 24, 2003.

* cited by examiner

METHOD, APPARATUS AND ARTICLE FOR COMPUTATIONAL SEQUENCE GENERATION AND PLAYING CARD DISTRIBUTION

BACKGROUND OF THE INVENTION

1. Technical Field

This invention is generally related to games of skill and chance, and in particular to distributing playing cards for card games.

2. Description of the Related Art

Card games are a well-known form of recreation and entertainment. Games are typically played with one or more decks of cards, where each deck typically includes 52 cards. Each deck of cards will typically include four suits of cards, including: hearts, diamonds, clubs, and spades, each suit including fourteen cards having rank: 2-10, Jack, Queen, King and Ace. Card games may, or may not, include wagering based on the game's outcome.

Decks of playing cards must be periodically shuffled to prevent the same sequences of playing card from continually reappearing. Shuffling may take place after every card in the deck or decks has been dealt, for example after several hands have been played. Shuffling may also interfere with, and even prevent, a player from gaining an unfair advantage over the house or other players by counting cards. Numerous card counting systems are known, and typically rely on a player keeping a mental count of some or all of the cards which have been played. For example, in the game of twenty-one or "blackjack" it is beneficial to determine when all cards with a rank of 5 have been dealt (i.e., fives strategy). Tens strategy is another card counting method useful in the game of twenty-one. In tens strategy, the player increments a count each time a card having a value of 10 appears, and decrements the count when card having a value less than appears. The count may be divided by the total number of cards remaining to be dealt to give the player an indication of how much the remaining deck favors the player with respect to the house. Other variations of card counting are well known in the art.

Manual shuffling tends to slow play down, so the gaming industry now employs numerous mechanical shufflers to speed up play and to more thoroughly shuffle the cards. The cards are typically shuffled several cards before the end of the deck(s), in an effort to hinder card counting, which may be particularly effective when only a few hands of cards remain (i.e., end game strategy). The ratio of the number of cards dealt to the total number of cards remaining in the deck(s) is commonly known as the penetration. The gaming industry is now introducing continuous shufflers in a further attempt to frustrate attempts at card counting. As the name implies, continuous shufflers mechanically shuffle the cards remaining to be dealt while one or more hands are being played.

While mechanical shufflers increase the speed of play and produce a more through shuffle over manual methods, there is still a need for improve in speed and/or thoroughness of the shuffle. In particular, current mechanical shuffling apparatus and methods are subject to incomplete shuffles due to the inherently mechanical nature of such devices. Additionally, mechanical shufflers are limited in the total number of decks they can manipulate.

SUMMARY OF THE INVENTION

Under one aspect, a method, apparatus and article computationally generates a playing card sequence, and distributes playing cards according the computationally generated playing card sequence.

Under one aspect, a method, apparatus and article computationally generates a pseudo-random playing card sequence, and distributes playing cards according the computationally generated pseudo-random playing card sequence.

In another aspect, a method, apparatus and article computationally generates a playing card sequence, and stores playing cards in order of the computationally generated playing card sequence, for later distribution.

In another aspect, a method, apparatus and article computationally generates a pseudo-random playing card sequence, and stores playing cards in order of the computationally generated pseudo-random playing card sequence, for later distribution.

In another aspect, a method, apparatus and article verifies and stores playing cards collected from participants such as players and dealer after play of one or more rounds or hands, for later distribution.

In a further aspect, a method, apparatus and article computationally generates a playing card sequence based on a desired house advantage, for example, adjusting the number of "virtual" decks of playing cards from which the defined playing card sequence is generated.

In a further aspect, a method, apparatus and article computationally generates a pseudo-random playing card sequence based on a desired house advantage, for example, adjusting the number of "virtual" decks of playing cards from which the pseudo-random playing card sequence is generated.

BRIEF DESCRIPTION OF THE DRAWINGS

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION OF THE INVENTION

In the following description, certain specific details are set forth in order to provide a thorough understanding of various embodiments of the invention. However, one skilled in the art will understand that the invention may be practiced without these details. In other instances, well-known structures associated with computers, servers, networks, imagers, and gaming or wagering apparatus have not been shown or described in detail to avoid unnecessarily obscuring descriptions of the embodiments of the invention.

Unless the context requires otherwise, throughout the specification and claims which follow, the word "comprise" and variations thereof, such as, "comprises" and "comprising" are to be construed in an open, inclusive sense, that is as "including, but not limited to."

The headings provided herein are for convenience only and do not interpret the scope or meaning of the claimed invention.

Wagering Environment Overview

Figure 1:
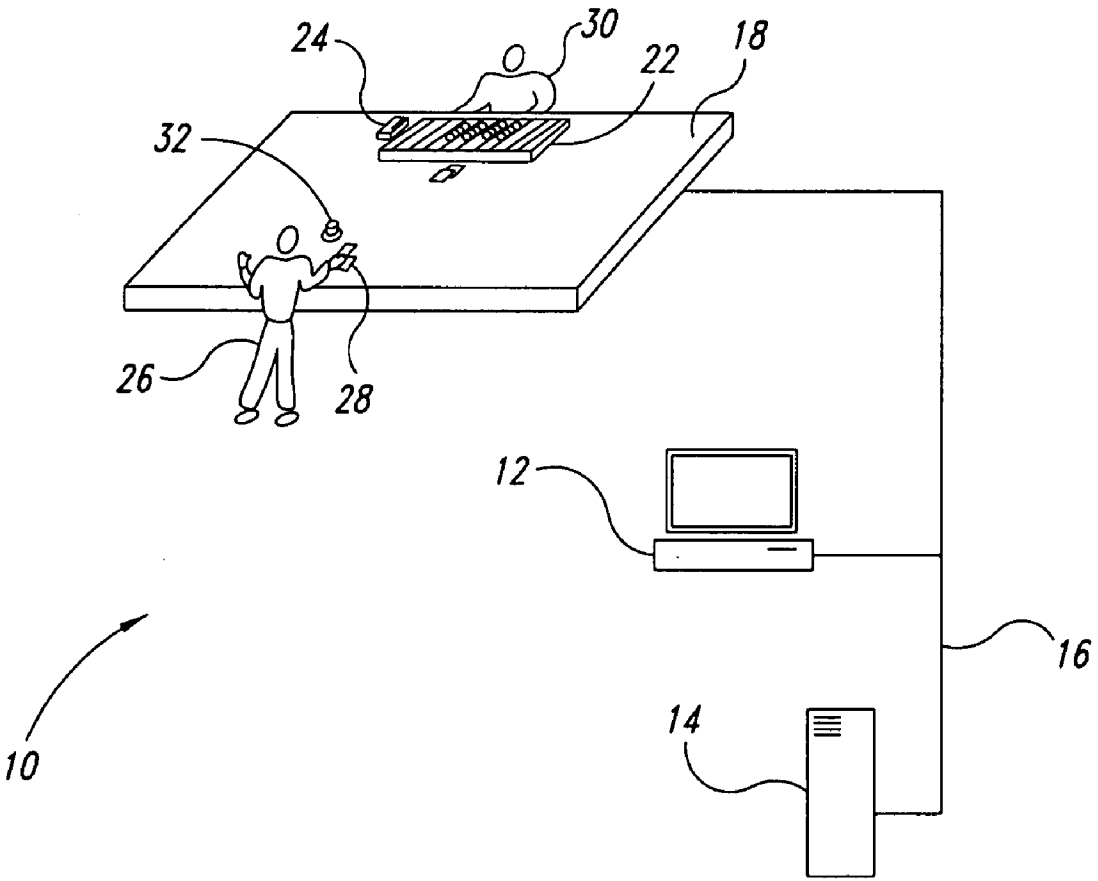
FIG. 1 is an isometric view of a networked automatic wager monitoring system in a gaming environment, including a networked playing card distribution device according to one illustrated embodiment of the invention.

FIG. 1 shows a networked automated wager monitoring system 10 including a host computing system 12, a server 14 and a network 16. The server 14 and network 16 couple the host computing system 12 to various gaming sensors, gaming actuators and/or gaming processors at a number of different wagering or gaming tables 18, such as a twenty-one or blackjack table, a baccarat table, poker or other card game table.

In one embodiment, the host computing system 12 acts as a central computing system, interconnecting the gaming tables of one or more casinos. In an alternative embodiment, the host computing system 12 is associated with a single gaming table, or a small group of gaming tables. In a further alternative, the host computing system 12 is associated with a single gaming table or group of gaming tables and is interconnected with other host computing systems.

The gaming sensors, gaming actuators and/or gaming processors and other electronics can be located in the gaming table, and/or various devices on the gaming table such as a chip tray 22 and/or a card distribution device 24. For example, suitable hardware and software for playing card based games such as "twenty-one" or "blackjack" are described in commonly assigned pending U.S. patent applications: Ser. No. 60/130,368, filed Apr. 21, 1999; Ser. No. 09/474,858, filed Dec. 30, 1999, entitled "METHOD AND APPARATUS FOR MONITORING CASINOS AND GAMING"; Ser. No. 60/259,658, filed Jan. 4, 2001; Ser. No. 09/849,456, filed May 4, 2001; and Ser. No. 09/790,480, filed Feb. 21, 2001, entitled "METHOD, APPARATUS AND ARTICLE FOR EVALUATING CARD GAMES, SUCH AS BLACKJACK".

A player 26 can place a wager on the outcome of the gaming event, such as the outcome of a hand of playing cards 28 dealt by a dealer 30 in a game of twenty-one or on the player or bank in a game of baccarat. The player 26 may place the wager by locating wagering pieces such as one or more chips 32 in an appropriate location on the gaming table 18.

Figure 2:
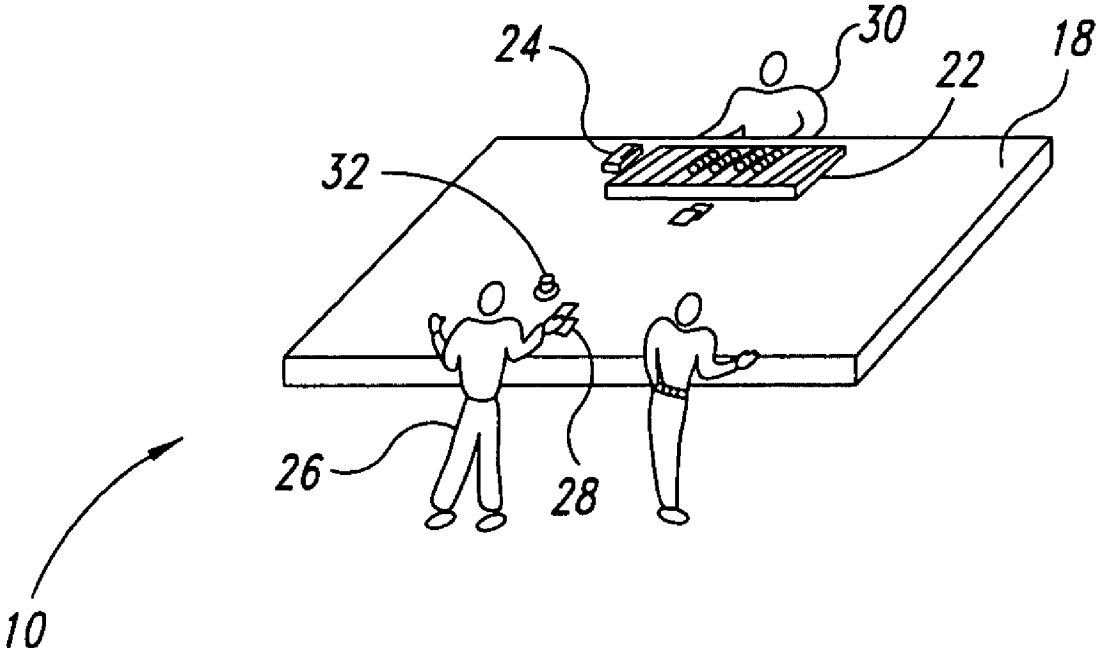
FIG. 2 is an isometric view of a gaming table, including a standalone playing card distribution device according to another illustrated embodiment of the invention.

FIG. 2 shows an alternative embodiment of the gaming table 18. This alternative embodiment, and those alternative embodiments and other alternatives described herein, are substantially similar to previously described embodiments, and common acts and structures are identified by the same reference numbers. Only significant differences in operation and structure are described below.

In FIG. 2, the gaming table 18 includes a standalone version of the card distribution device 24, and otherwise does not employ the electronics of FIG. 1. Thus, the dealer and/or pit boss manually monitors the game play and wagering.

Table System Hardware

Figure 3:
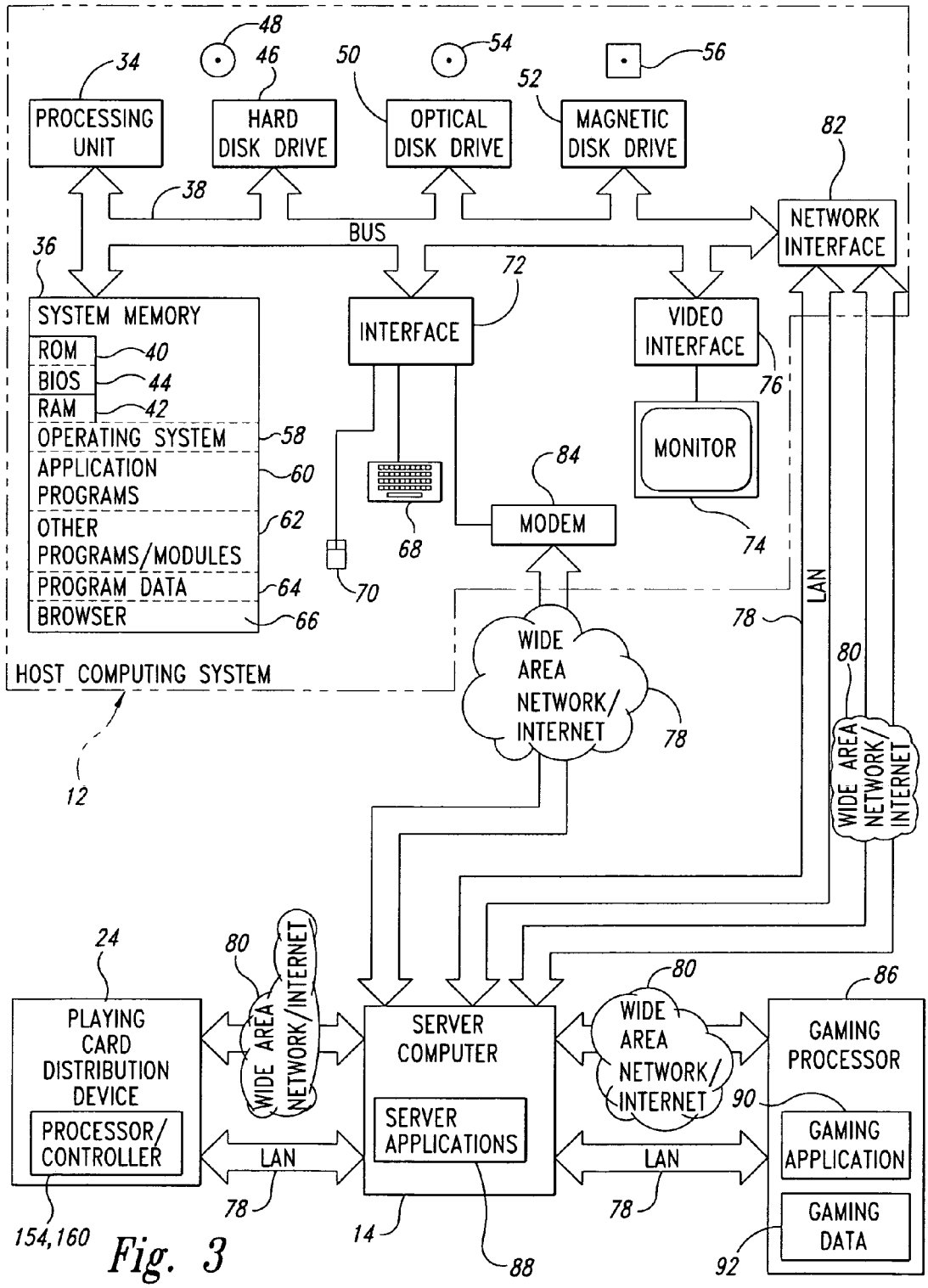
FIG. 3 is a functional block diagram of the networked automatic wager monitoring system of FIG. 1.
Figure 4A:
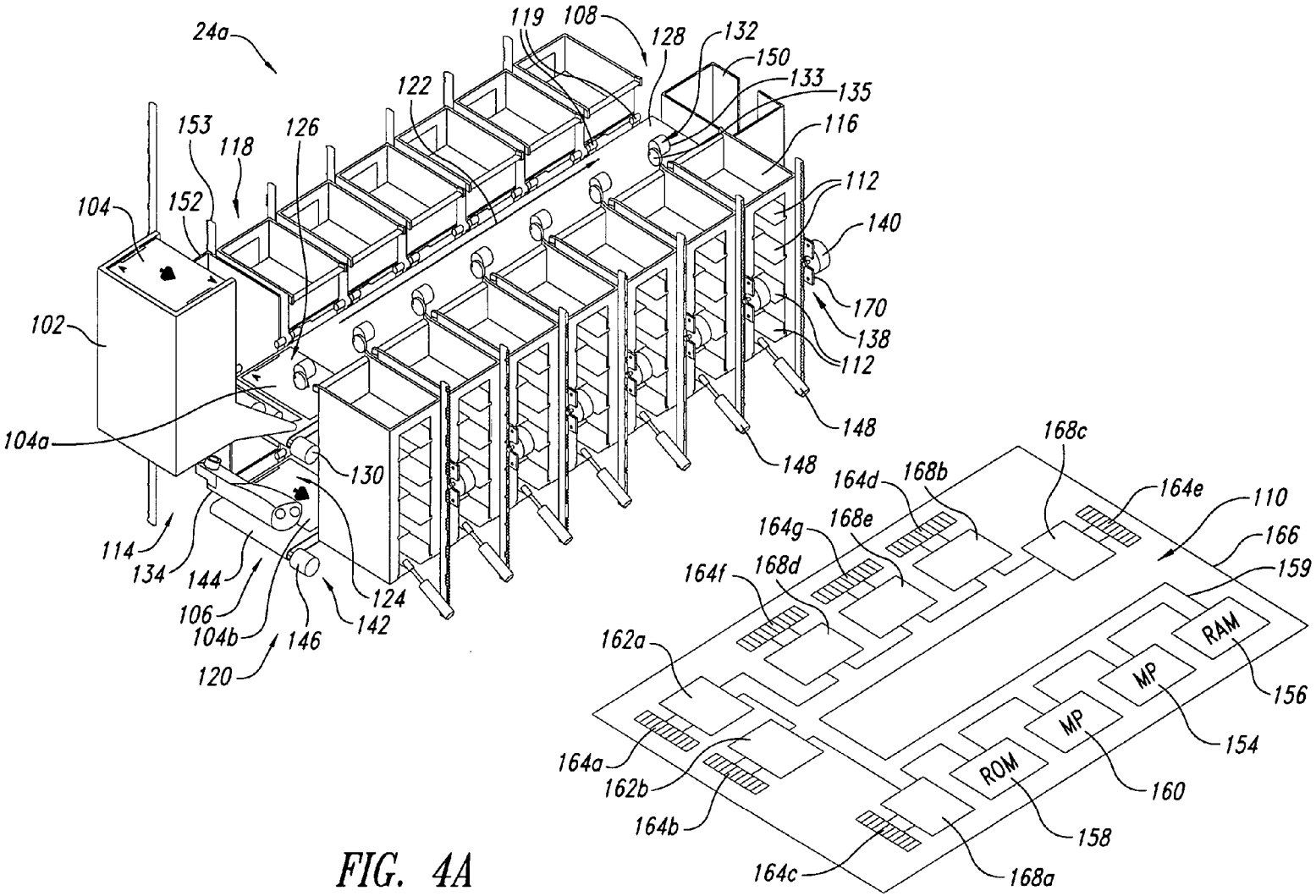
FIG. 4A is a front right top isometric view of one embodiment of the playing card distribution device in the form of one illustrated embodiment of a shuffling mechanism of a card shuffling device comprising storage receptacles, transport mechanism and a processor programmed to produce a computationally generated sequence of numbers identifying playing cards, particularly suited for the standalone operation of FIG. 2.
Figure 4B:
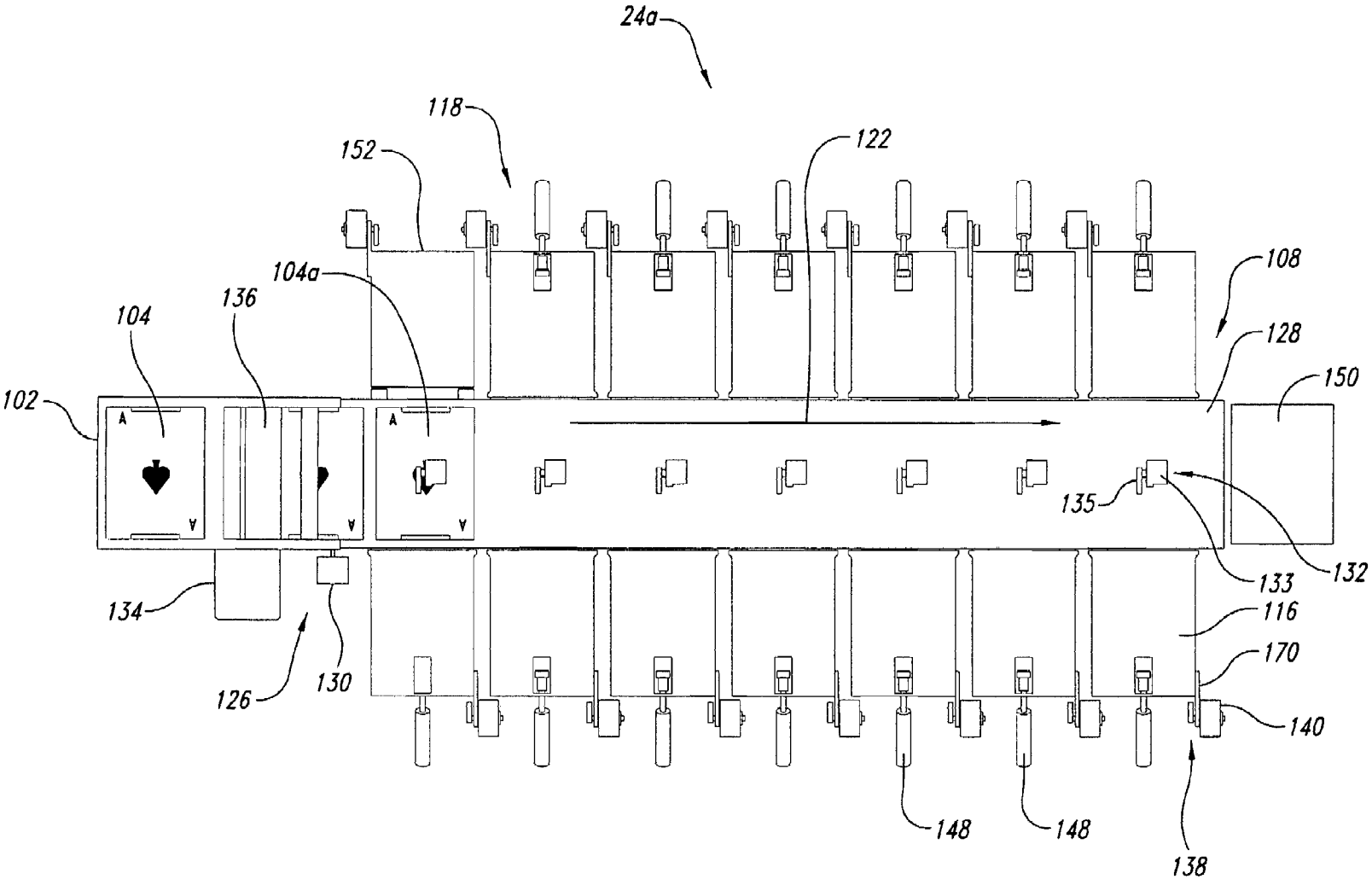
FIG. 4B is a top plan view of the card shuffling device of FIG. 4A.
Figure 4C:
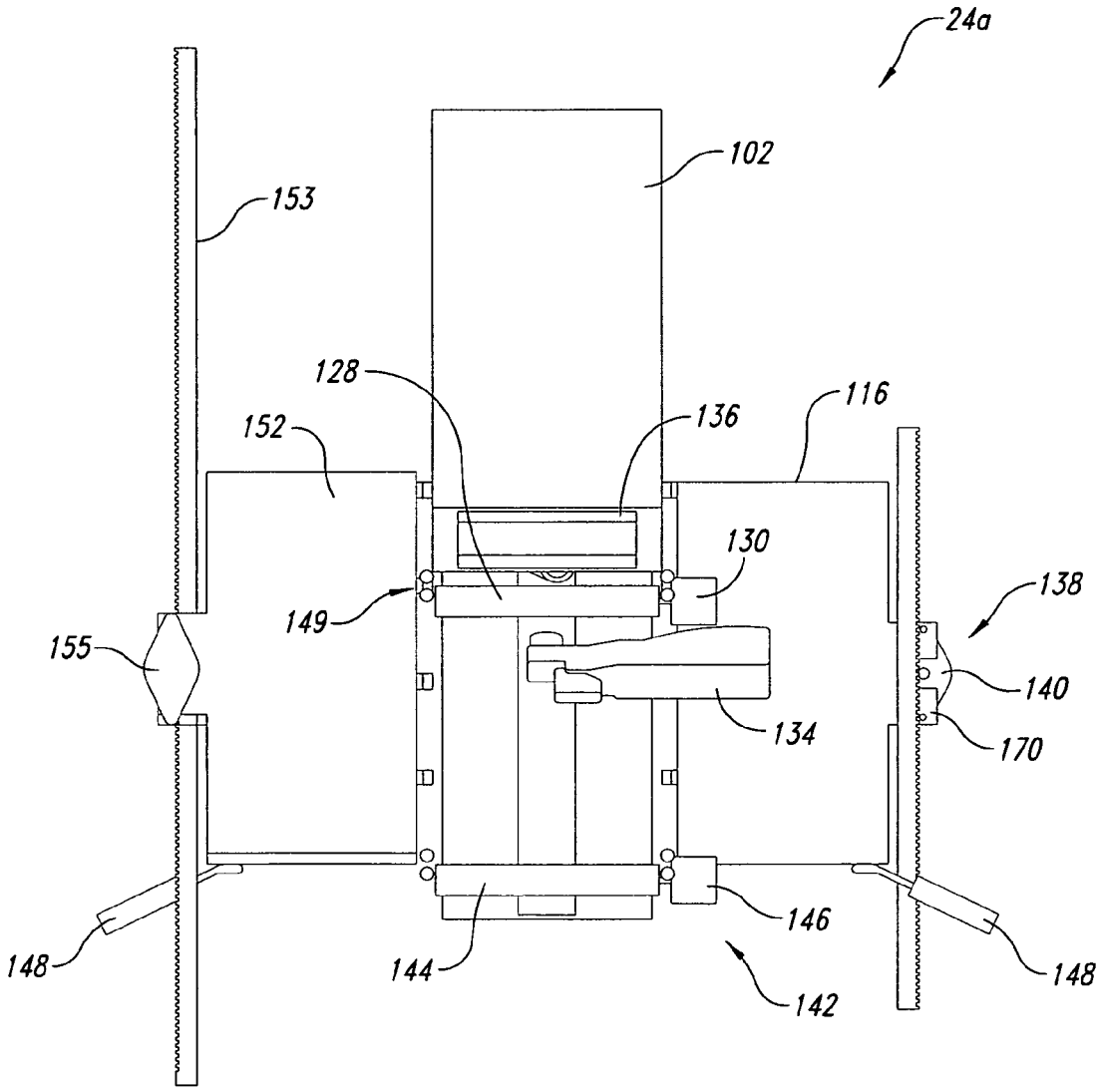
FIG. 4C is a front elevational view of the card shuffling device of FIG. 4A.
Figure 4D:
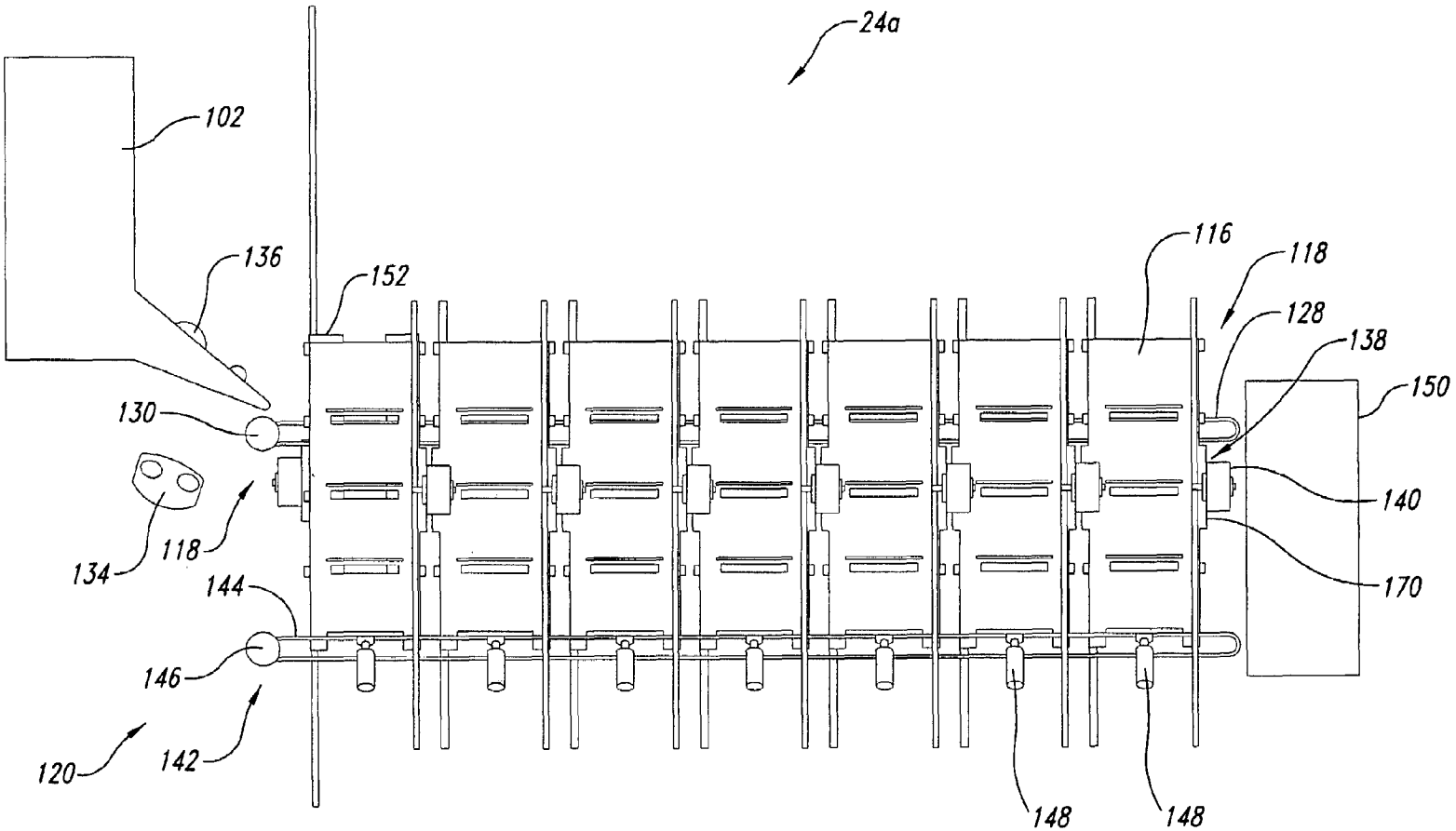
FIG. 4D is a side elevational view of the card shuffling device of FIG. 4A.

FIG. 3 and the following discussion provide a brief, general description of a suitable computing environment in which embodiments of the invention can be implemented, particularly those of FIG. 1. Although not required, embodiments of the invention will be described in the general context of computer-executable instructions, such as program application modules, objects, or macros being executed by a computer. Those skilled in the relevant art will appreciate that the invention can be practiced with other computer system configurations, including hand-held devices, multiprocessor systems, microprocessor-based or programmable consumer electronics, personal computers ("PCs"), network PCs, mini computers, mainframe computers, and the like. The invention can be practiced in distributed computing environments where tasks or modules are performed by remote processing devices, which are linked through a communications network. In a distributed computing environment, program modules may be located in both local and remote memory storage devices.

Referring to FIG. 1, a conventional mainframe or minicomputer, referred to herein as the host computing system 12, includes a processing unit 34, a system memory 36 and a system bus 38 that couples various system components including the system memory 36 to the processing unit 34. The host computing system 12 will at times be referred to in the singular herein, but this is not intended to limit the application of the invention to a single host computer since in typical embodiments, there will be more than one host computer or other device involved. The automated wager monitoring system 10 may employ other computers, such as conventional personal computers, where the size or scale of the system allows. The processing unit 34 may be any logic processing unit, such as one or more central processing units (CPUs), digital signal processors (DSPs), application-specific integrated circuits (ASICs), etc. Unless described otherwise, the construction and operation of the various blocks shown in FIG. 1 are of conventional design. As a result, such blocks need not be described in further detail herein, as they will be understood by those skilled in the relevant art.

The system bus 38 can employ any known bus structures or architectures, including a memory bus with memory controller, a peripheral bus, and a local bus. The system memory 36 includes read-only memory ("ROM") 40 and random access memory ("RAM") 42. A basic input/output system ("BIOS") 44, which can form part of the ROM 40, contains basic routines that help transfer information between elements within the host computing system 12, such as during start-up.

The host computing system 12 also includes a hard disk drive 46 for reading from and writing to a hard disk 48, and an optical disk drive 50 and a magnetic disk drive 52 for reading from and writing to removable optical disks 54 and magnetic disks 56, respectively. The optical disk 54 can be a CD-ROM, while the magnetic disk 56 can be a magnetic floppy disk or diskette. The hard disk drive 46, optical disk drive 50 and magnetic disk drive 52 communicate with the processing unit 34 via the bus 38. The hard disk drive 46, optical disk drive 50 and magnetic disk drive 52 may include interfaces or controllers (not shown) coupled between such drives and the bus 38, as is known by those skilled in the relevant art. The drives 46, 50 and 52, and their associated computer-readable media, provide nonvolatile storage of computer readable instructions, data structures, program modules and other data for the host computing system 12. Although the depicted host computing system 12 employs hard disk 46, optical disk 50 and magnetic disk 52, those skilled in the relevant art will appreciate that other types of computer-readable media that can store data accessible by a computer may be employed, such as magnetic cassettes, flash memory cards, digital video disks ("DVD"), Bernoulli cartridges, RAMs, ROMs, smart cards, etc.

Program modules can be stored in the system memory 36, such as an operating system 58, one or more application programs 60, other programs or modules 62 and program data 64. The system memory 36 may also include a Web client or browser 66 for permitting the host computing system 12 to access and exchange data with sources such as web sites of the Internet, corporate intranets, or other networks as described below, as well as other server applications on server computers such as those further discussed below. The browser 66 in the depicted embodiment is markup language based, such as Hypertext Markup Language (HTML), Extensible Markup Language (XML) or Wireless Markup Language (WML), and operates with markup languages that use syntactically delimited characters added to the data of a document to represent the structure of the document. A number of Web clients or browsers are commercially available such as NETSCAPE NAVIGATOR from America Online, and INTERNET EXPLORER available from Microsoft of Redmond, Wash.

While shown in FIG. 1 as being stored in the system memory 36, the operating system 58, application programs 60, other programs/modules 62, program data 64 and browser 66 can be stored on the hard disk 48 of the hard disk drive 46, the optical disk 54 of the optical disk drive 50 and/or the magnetic disk 56 of the magnetic disk drive 52. An operator, such as casino personnel, can enter commands and information into the host computing system 12 through input devices such as a keyboard 68 and a pointing device such as a mouse 70. Other input devices can include a microphone, joystick, game pad, scanner, etc. These and other input devices are connected to the processing unit 34 through an interface 72 such as a serial port interface that couples to the bus 38, although other interfaces such as a parallel port, a game port or a wireless interface or a universal serial bus ("USB") can be used. A monitor 74 or other display device is coupled to the bus 38 via a video interface 76, such as a video adapter. The host computing system 12 can include other output devices, such as speakers, printers, etc.

The host computing system 12 can operate in a networked environment using logical connections to one or more remote computers, such as the server computer 14. The server computer 14 can be another personal computer, a server, another type of computer, or a collection of more than one computer communicatively linked together and typically includes many or all of the elements described above for the host computing system 12. The server computer 14 is logically connected to one or more of the host computing systems 12 under any known method of permitting computers to communicate, such as through a local area network ("LAN") 78, or a wide area network ("WAN") or the Internet 80. Such networking environments are well known in wired and wireless enterprise-wide computer networks, intranets, extranets, and the Internet. Other embodiments include other types of communication networks including telecommunications networks, cellular networks, paging networks, and other mobile networks.

When used in a LAN networking environment, the host computing system 12 is connected to the LAN 78 through an adapter or network interface 82 (communicatively linked to the bus 38). When used in a WAN networking environment, the host computing system 12 may include a modem 84 or other device, such as the network interface 82, for establishing communications over the WAN/Internet 80. The modem 84 is shown in FIG. 1 as communicatively linked between the interface 72 and the WAN/Internet 78. In a networked environment, program modules, application programs, or data, or portions thereof, can be stored in the server computer 14. In the depicted embodiment, the host computing system 12 is communicatively linked to the server computer 14 through the LAN 78 or the WAN/Internet 80 with TCP/IP middle layer network protocols; however, other similar network protocol layers are used in other embodiments, such as User Datagram Protocol ("UDP"). Those skilled in the relevant art will readily recognize that the network connections shown in FIG. 1 are only some examples of establishing communication links between computers, and other links may be used, including wireless links.

The server computer 14 is communicatively linked to the sensors, actuators, and gaming processors 86 of one or more gaming tables 18, typically through the LAN 78 or the WAN/Internet 80 or other networking configuration such as a direct asynchronous connection (not shown). The server computer 14 is also communicatively linked to the card distribution device 24, typically through the LAN 78 or the WAN/Internet 80 or other networking configuration such as a direct asynchronous connection (not shown).

The server computer 14 includes server applications 88 for the routing of instructions, programs, data and agents between the gaming processors 86 and the host computing system 12. For example the server applications 88 may include conventional server applications such as WINDOWS NT 4.0 Server, and/or WINDOWS 2000 Server, available from Microsoft Corporation or Redmond, Wash. Additionally, or alternatively, the server applications 88 can include any of a number of commercially available Web servers, such as INTERNET INFORMATION SERVICE from Microsoft Corporation and/or IPLANET from Netscape.

The gaming processor 86 can include gaming applications 90 and gaming data 92. The gaming applications 90 can include instructions for acquiring wagering and gaming event information from the live gaming at the game position, such as instructions for acquiring an image of the wagers and identifiers on playing cards. The gaming applications 90 can also include instructions for processing, at least partially, the acquired wagering and gaming event information, for example, identifying the position and size of each wager and/or the value of each hand of playing cards. Suitable applications are described in one or more of commonly assigned U.S. patent applications: Ser. No. 60/130,368, filed Apr. 21, 1999; Ser. No. 09/474,858 filed Dec. 30, 1999, entitled "METHOD AND APPARATUS FOR MONITORING CASINOS AND GAMING"; Ser. No. 60/259,658, filed Jan. 4, 2001; Ser. No. 09/849,456 filed May 4, 2001; and Ser. No. 09/790,480, filed Feb. 21, 2001, entitled "METHOD, APPARATUS AND ARTICLE FOR EVALUATING CARD GAMES, SUCH AS BLACKJACK".

Additionally, the gaming applications 90 may include statistical packages for producing statistical information regarding the play at a particular gaming table, the performance of one or more players, and/or the performance of the dealer 30 and/or game operator 66. The gaming applications 90 can also include instructions for providing a video feed of some or all of the gaming position. Gaming data may include outcomes of games, amounts of wagers, average wager, player identity information, complimentary benefits information ("comps"), player performance data, dealer performance data, chip tray accounting information, playing card sequences, etc. The gaming applications 90 can further include instructions for handling security such as password or other access protection and communications encryption. Thus, the server 12 can route wagering related information between the gaming tables and the host computing system 12.

Card Distribution Devices

Standalone Card Distribution Device

FIGS. 4A-4D show one embodiment of the card distribution device 24, in the form of a first card shuffling device 24*a*.

The first card shuffling device 24*a* includes a housing 100 (FIGS. 1 and 2), a card receiver 102 for receiving printed playing cards 104, an outlet 106 for providing the playing cards 104 in a processor generated or produced order or sequence (e.g., predefined order or sequence; non-pseudo-random order or sequence, or pseudo-random order or sequence), and a sorting or shuffling mechanism 108 for causing the playing cards 104*b* to be delivered at the outlet 106 in the processor produced order or sequence. Use of a processor to produce a pseudo-random order or sequence addresses at least some of the drawbacks associated with conventional mechanical shuffler systems, allowing more truly random sequences and thereby reducing sequences of groups of playing cards that repeat from game-to-game (i.e., "clumping") and/or allowing casinos to set desired odds, for example, by varying the size of the number of sets of playing cards (e.g., decks) from which the pseudo-random sequence is generated. In this respect, it is possible to employ a greater or lesser number of playing cards in producing the pseudo-random sequence than the actual number of playing cards housed by the playing card shuffling device 24*a*, potentially permitting an unlimited range for the "virtual shuffling" process. Additionally, or alternatively, the processor produced sequence may not be random or pseudo-random. For example, the processor generated sequence may be non-pseudo-random, or only partially pseudo-random, for example, to allow progressive type gaming. One example, may cause the processor produced sequence to include a defined subset of playing cards that correspond to a jackpot or enhanced payment when such sequence is received in the hand of one player, or alternatively in the hands of multiple players, during a card game. In this way, the card manufacturer and/or casino can assure that a jackpot situation may only occur within some acceptable range of probabilities. Such a computationally generated sequence may be incorporated with, or stand alone from, the computationally generated pseudo-random number generation generally discussed herein.

The housing 100 may be sized to be located on the gaming table 18 (FIGS. 1 and 2) for easy access by the dealer 30, for example, replacing standard card shoes that are typically found on gaming tables where card games are played. Alternatively, the first card shuffling device 24*a* may be housed within or under the surface of the gaming table 18, with suitable recesses formed in the surface of the gaming table 18 to provide access to deposit and remove playing cards to and from the first card shuffling device 24*a*.

The card receiver 102 is accessible from an exterior of the housing 100, allowing playing cards 104 to be loaded into the card receiver 102 of the first card shuffling device 24*a* at the gaming table 18, or in another location, such as a room (not shown) that is closed to the public. Thus, the first card shuffling device 24*a* may be initially loaded in a secure location, then placed on the gaming table 18, and thereafter, the dealer 30 may return the playing cards 28 (FIGS. 1 and 2) picked up after a game, back into the first card shuffling device 24*a* for reuse. Casino personnel may, from time-to-time, reload the first card shuffling device 24*a*. For example, the casino personnel may reload the first card shuffling device 24*a* once every week or two for security reasons, or whenever too many of the playing cards become damaged or when the playing cards become worn (i.e., defective playing cards).

The shuffling mechanism 108 of the first card shuffling device 24*a* includes a control system 110 (Figure), a number of card holders, collectively referenced as 112 for holding the printed playing cards 104 and a transport mechanism 114 for distributing the playing cards 104 to the card holders 112 and/or for distributing playing cards from the card holders 112 to the outlet 106, under the control of the control system 110.

In the embodiment illustrated in FIGS. 4A-4D, there are fifty-two card holders 112, one for each of the standard playing card combinations of rank (i.e., 2-10, Jack, Queen, King Ace) and suit (i.e., Heart, Clubs, Spades, Diamonds). In the embodiment illustrated in FIGS. 4A-4D, the card holders 112 are organized in groups of four into respective ones of thirteen receptacles or bins 116. Thus, there is one receptacle 116 for each rank, and one card holder 112 for each suit. The card holders 112 may be organized vertically into different levels, as illustrated in FIGS. 4A-4D.

While illustrated as separate bin type receptacles 116, some embodiments of the card shuffling device 24*a* may employ a carrousel with a number of slot type receptacles for holding the playing cards, or may employ other devices for temporarily storing the playing cards. In other embodiments, there may be a fewer or greater number of card holders 112, for example, some embodiments may employ only thirteen card holders 112 since in some card games (e.g., blackjack, baccarat) the suit of a playing card does not effect the outcome of the game. Thus, playing cards can be organized into a limited set of card holders 112 according to rank only, with various suits mixed together in whatever order they are encountered during loading of the card dispensing device 24.

Transport Mechanisms

In the embodiment illustrated in FIGS. 4A-4D, the transport mechanism 114 includes an input transport mechanism 118 and an output transport mechanism 120. The input and output transport mechanisms 118, 120, respectively, may share some common components. The input transport mechanism 118 defines a card input path (identified by arrow 122) extending between the card receiver 102 and the card holders 112, while the output transport mechanism 120 defines a card output path (identified by arrow 124) extending between the card holders 112 and the outlet 106.

Input Transport Mechanism

The input transport mechanism 118 may include an input conveyor 126 such as belt and/or rollers 128 driven by one or more conveyor motors 130 to move playing cards 104 from the card receiver 102 to the card holders 112, under control of the control system 110. The conveyer motor(s) 130 can take the form of a one or more stepper motors, that drive the belt or rollers in small increments or steps, such that the playing card 104*a* is propelled incrementally or stepped through the card input path 122, pausing slightly between each step, for example when aligned with a desired one of the receptacles. Stepper motors and their operation are well known in the art so will not be described in further detail. Alternatively, the input transport mechanism 118 may employ a standard continuous motor to propel the playing card 104*a* along the card input path 122. The input transport mechanism 118 may also include a number of guide rollers (not shown) to guide the playing card 104 along a portion of the card input path 122. Typically the guide rollers are not driven, although in some embodiments one or more of the guide rollers can be driven where suitable for the particular topology. While a particular input transport mechanism 118 is illustrated, many other suitable transport mechanisms will be apparent to those skilled in the art of printing. Reference can be made to the numerous examples of transport mechanisms for printers.

The input transport mechanism 118 may include one or more card input actuators 132, such as solenoids 133 and cams 135 arranged along the input conveyer 126 at respective entrances of each of the card holders 112. The card input actuators 132 are selectively actuatable under the control of the control system 110 to cause a playing card 104*a* to be moved from the input conveyer 126 into a selected one of the card holders 112. Examples of just some of the possible card input actuators 132 may include a cam, arm, lever, roller, and/or belt. Additionally, the input transport mechanism 118 may include one or more driven card injector rollers and/or belts 119 positioned to advance the card from the input conveyer 126 completely into the respective card holder 112.

Card Reader

The input transport mechanism 118 may further include a card reader 134, positioned along the card input path 122 for reading identifying information from the playing cards 104. For example, one or more card readers 134 may be positioned toward the starting end of the input conveyor 126.

The card readers 134 may take a variety of forms. For example, the card readers 134 may take the form of optical scanners, optical imagers such as still, motion and/or video cameras, or other optical sensors, where the playing cards 104 carry optical identifiers, such as barcode symbols, standard playing card rank and/or suit markings, or other printed or written indicia, whether detectable in the human visual range or not. For example, the card reader 134 may include one or more linear or two-dimensional arrays of either complimentary metal-oxide silicon (CMOS) micro-imager devices or charge coupled devices ("CCDs").

With respect to the imager embodiment, a field-of-view of the card reader 134 may be fixed with respect to the input conveyer 126 or may move with respect thereto. Any of a variety of methods and structures may be employed for sweeping the field-of-view of the card reader 134. For example, the card reader 134 can be pivotally mounted for movement with respect to the input conveyer 126. Alternatively, a mirror or other optical component (not shown) can be pivotally mounted for movement with respect to the card reader 134 and the input conveyer 126.

With respect to the scanner embodiment, a field-of-view of the card reader 134 may be fixed with respect to the input conveyer 126 while a light source (not shown) such as an laser or light emitting diode (LED) can be pivotally mounted for movement with respect to the input conveyer 126. Alternatively, a mirror or other optical component (not shown) can be pivotally mounted for movement with respect to the light source and the input conveyer 126.

In yet another embodiment, the card reader head 134 and field-of-view of the card reader 134 may remained fixed while the playing cards 104*a* are transported past the field-of-view of the card reader 134.

As briefly discussed above, the card reader 134 may also include optical components such as a light source, mirrors, reflectors, lenses, filters and the like (not shown). The card reader 134 may also include a card presence detector (not shown) that determines when there is a playing cards in position to be read, although such a detector is optional. The card presence detector may take the form of a light source directing light to a reflector across the card receiver 102 or belt and/or rollers 128, and a light detector to receive the reflected light. The presence of playing cards 104*a* at the start of the card input path 122 interrupts the light, which can trigger the card reader 134. Alternatively, in some embodiments, the card reader 134 remains in an ON or active state, relying on the activation of a light source (not shown) to capture images of the playing cards 104*a* on the input conveyer 126.

Also for example, the card reader 134 may take the form of one or more magnetic sensors (not shown) where the playing cards 104 include magnetic particles (e.g., remanent or magnetic strip). As a further example, the card reader 134 may take the form of a wireless receiver and/or transceiver (not shown), for example, where the playing cards 104 carry an active or passive resonator or transponder such as a radio frequency identification (RFID) circuit.

The construction and operation of imagers and scanners for reading machine-readable symbols is generally known in the field of automatic data collection ("ADC"), so will not be described in further detail in the interest of brevity. The structure and operation of machine-readable symbol readers is generally discussed in The Bar Code Book, Palmer, Roger, C., Helmers Publishing, Inc., Peterborough, N.H. (Third Edition).

Card Cleaning Mechanism

The input transport mechanism 118 may further include a card cleaning mechanism 136 positioned along the card input path 122. For example, one or more rollers or brushes may be positioned toward a starting end of the input conveyor 126 to remove debris from the playing cards 104. The card cleaning mechanism 136 can significantly improve the rate of successively reading playing cards 104.

Card Holders

The card holders 112 are movable with respect to the input conveyer 126. For example, the receptacles 116 may be coupled to one or more rack and pinion structures 138, which are driven by one or more motors 140. The control system 11 controls the motor(s) 140, for example, via one or more motor controllers, to position an appropriate card holder 112 at the level of the input conveyer 126, at which time the control system 110 may activate the appropriate one of the card input actuators 132 to move the playing card 104*a* from the input conveyer 126 into the desired card holder 112. This permits playing cards 104 having identical suits to be stored in the same card holder 112 (e.g., level in receptacle 116). Alternatively, the input conveyer 126 can be coupled to move while the receptacles 116 and/or card holders 112 remain fixed, or both the input conveyer 126 and receptacles 116 and/or card holder 112 can move.

Output Transport Mechanism

The output transport mechanism 120 may include an output conveyor 142 such as belt or rollers 144 driven by one or more motors 146 to move playing cards 104*b* from the card holders 112 to the outlet 106, in a similar fashion to that discussed above in reference to the input transport mechanism 118. The card holders 112 are movable with respect to the output conveyer 142 in a similar manner to the input conveyer 126, as discussed above. In this respect, both the input and the output transport mechanisms 118, 120, respectively, may share common structure. The output transport mechanism 120 may include one or more card output actuators 148, such as solenoids arranged along the output conveyer 142 at respective exits of each of the card holders 112. The card output actuators 148 are selectively actuatable under the control of the control system 110 to cause a playing card to be moved from a selected one of the card holders 112 onto the output conveyer 126. Examples of just some of the possible card output actuators 148 may include an arm, lever, roller, and/or belt. Additionally, the output transport mechanism 120 may include one or more driven card ejector rollers and/or belts 149 positioned to advance the playing card 104*b* completely out of the respective card holder 112 and onto the output conveyer 142.

Defective Card Holder

The first card shuffling device 24*a* may also include a defective card holder 150 for holding playing cards that are damaged or otherwise undesirable for use in playing of the game. For example, playing cards that are so worn that the playing card cannot be inconsistently read may be removed from play. The defective card holder 150 may be at the end of the input conveyor 126 such that playing cards that are not sorted into any of the card holder 112 are automatically placed in the defective card holder 150. Additionally, or alternatively, the input transport mechanism 118 can include a dedicated actuator (not shown) such as a solenoid, for moving undesirable playing cards from the input conveyor 126 to the defective card holder 150. Examples of just some of the possible solenoid structures to remove playing cards 104*a* from the input conveyor 126 may include an arm, lever, roller, and/or belt. The defective card holder 150 may be fixed with respect to the input conveyer 126. Alternatively, the defective card holder 150 may be movable with respect to the input conveyer 126 in a similar manner to the card holders, as discussed above. For example, the defective card holder 150 can be associated with a rack and pinion (not shown) driven by a motor (not shown) under the control of the control system 110.

Output Card Holder

Further, the first card shuffling device 24*a* may optionally also include an output card holder 152 for temporarily storing ordered playing cards before releasing the playing cards to the dealer 30 (FIG. 1). Such an embodiment will include one or more actuators for moving playing cards into and/or out of the output card holder 152. The output card holder 152 may be movable with respect to the output conveyer 142 in a similar manner to the card holders, as discussed above. For example, the output card holder 152 can be associated with a rack and pinion 153 driven by a motor 155 (FIG. 4C) under the control of the control system 110.

Control System

The control system 110 may include one or more microcontrollers, microprocessors, application specific integrated circuits, and/or other electrical and/or electronic circuitry. As illustrated, the control system includes a first microprocessor 154, volatile memory such as a Random Access Memory ("RAM") 156, and a persistent memory such as a Read Only Memory ("ROM") 158 coupled via a bus 159. The control system 110 may, for example, include an optional second microprocessor or ASIC 160, which may be dedicated to generating or producing the computationally generated sequence (e.g., pseudo-random numbers, non-pseudo-random numbers, or partially pseudo-random numbers) while the first microprocessor 154 receives input from the various sensors, processes the input, and provides control signals to the various actuators and motors either directly or via various intermediary controllers such as motor controllers collectively referenced as 162, and connectors or ports collectively referenced as 164 carried, for example, by a circuit board 166 mounted in the housing 100 of the card shuffling device 24*a*.

As illustrated, the control system 110 includes a first motor controller 162*a* coupled via a connector 164*a* for controlling the motor 130 of the input transport mechanism 118 in response to motor control signals from the microprocessor 154. As illustrated, the control system 110 also includes a second motor controller 162*b* coupled via a connector 164*b* for controlling the motor 146 of the output transport mechanism 120 in response to motor control signals from the microprocessor 154.

The control system 110 includes a variety of sensors. The sensors may be coupled to the microprocessors 154, 160 via respective connectors or ports 164 and optional buffers 168. For example, the card reader 134 may be coupled to the microprocessor 154 via a connector 164*c* and suitable buffer or preprocessor such as a digital signal processor 168*a*. Also for example, the control system 110 may include one or more encoders 170 for detecting movement and/or position of the various elements of the input and output transport mechanisms 118, 120, respectively. For example, the encoder 170 may take the form of a linear scale carried by the rack or housing, and an optical sensor opposed to a linear scale. Likewise, the encoder 170 may take the form of a Reed switch or similar device for detecting repetitive motion of a magnet, such as the rotation of a magnet coupled to the pinion or drive shaft of a motor (e.g., 140) driving the pinion. A large variety of different encoders are known to those of skill in the relevant art, which may be suitable for the particular application within the card distribution device 24. The encoders may be coupled to the microprocessor 154 via a connector 164*d* and an optional buffer 168*b*.

The sensors may also take the form of a card level detector (not shown) for detecting a level or number of playing cards in the card receiver 102, the card holders 112, defective card holder 150, and/or output card holder 152. Suitable card level detectors can include a light source and receiver pair and a reflector spaced across the playing card holder from the light source and receiver pair. Thus, when the level of playing cards 104 in the associated card receiver 102, the card holders 112, defective card holder 150, and/or output card holder 152 drops below the path of the light, the card level detector detects light reflected by the reflector, and provides a signal to the microprocessor 154 indicating that additional playing cards 104 should be added or removed. The card shuffling device 24*b* can employ other level detectors, such as mechanical detectors. A connector 164*e* and an optional buffer 168*c* may couple various ones of the sensors to the microprocessor 154.

Similarly, one or more connectors 164*f* and optional buffers 168*d* may connect the microprocessor 154 to the card input actuators 132, while one or more connectors 164*g* and optional buffers 168*e* may connect the microprocessor 154 to the card output actuators 148.

The microprocessor 154 or microprocessor 160 executes instructions stored in RAM 156, ROM 158 and/or the microprocessor's own onboard registers (not shown) for generating a playing card sequence (e.g., pseudo-random playing card sequence, non-pseudo-random playing card sequence; or partially pseudo-random playing card sequence) and controlling the input and/or output transport mechanisms 118, 120, respectively, to deliver playing cards 104 in the order of the computationally generated playing card sequence. The control system 110 may produce a value corresponding to one playing card rank and/or suit as each playing card is delivered, or the control system 110 may produce a number of values corresponding to a number of playing card rank and/or suit before the playing cards are delivered.

In one embodiment, the microprocessor 154 or microprocessor 160 computationally generates a random playing card sequence from a set of playing card values. Random number generation on computers is well known in the computing arts. Mathematicians do not generally consider computer generated random numbers to be truly random, and thus commonly refer to such numbers as being pseudo-random. However such numbers are sufficiently random for most practical purposes, such as distributing playing cards to players. Hence, while we denominate the computer or processor generated values as being pseudo-random, such term as used herein and in the claims should include any values having a suitable random distribution, whether truly mathematically random or not.

In another embodiment, the microprocessor 154 or microprocessor 160 computationally generates a playing card sequence from a set of playing card values based on a non-pseudo random algorithm. This approach may be used where, for example, the resulting sets of playing cards will be distributed pseudo-randomly. Alternatively, or additionally, this approach may allow sets of playing cards to be distributed with a known likelihood of containing one or more jackpot or enhanced payout combinations. For example, it may be desirable to include a defined "jackpot" combination (e.g., three ACE of Hearts) in every thousand sets of playing cards produced. This affords the opportunity to employ jackpot or enhanced payouts for particular, unusual playing card combinations that occur in any particular hand or number of hands. This also affords the opportunity to employ progressive gaming in a card game, for example, allowing players to pay into a common pot, which grows until the unusual jackpot combination occurs in a hand. A non-pseudo-random algorithm may ensure that the particular combination or combination(s) can only occur a fixed number of times.

In yet a further embodiment, the microprocessor 154 or microprocessor 160 computationally generates a playing card sequence from a set of playing card values based on a partially pseudo-random algorithm. For example, the partially pseudo-random algorithm may be weighted or defined to computationally generate a sequence including a defined "jackpot" combination of playing cards within some desired probability as part of the pseudo-random number generation. Alternatively, or additionally the partially pseudo-random algorithm may simply produce the "jackpot" combination after producing a defined number of pseudo-random values.

Thus, the card shuffling device 24*a* of FIGS. 4A-4D provides a standalone card distribution device for distributing playing cards in a computationally generated sequence, which may be used at any gaming position. Since the first card shuffling device 24*a* includes a microprocessor 154, the first card shuffling device 24*a* is particularly suited for the manually monitored gaming table 18 of FIG. 2, where the card shuffling device 24*a* operates in a standalone mode. However, the first card shuffling device 24*a* can operate as an integral portion of the automated wager monitoring system 10, or in conjunction with such a system 10.

Integrated Card Distribution Device

Figure 5:
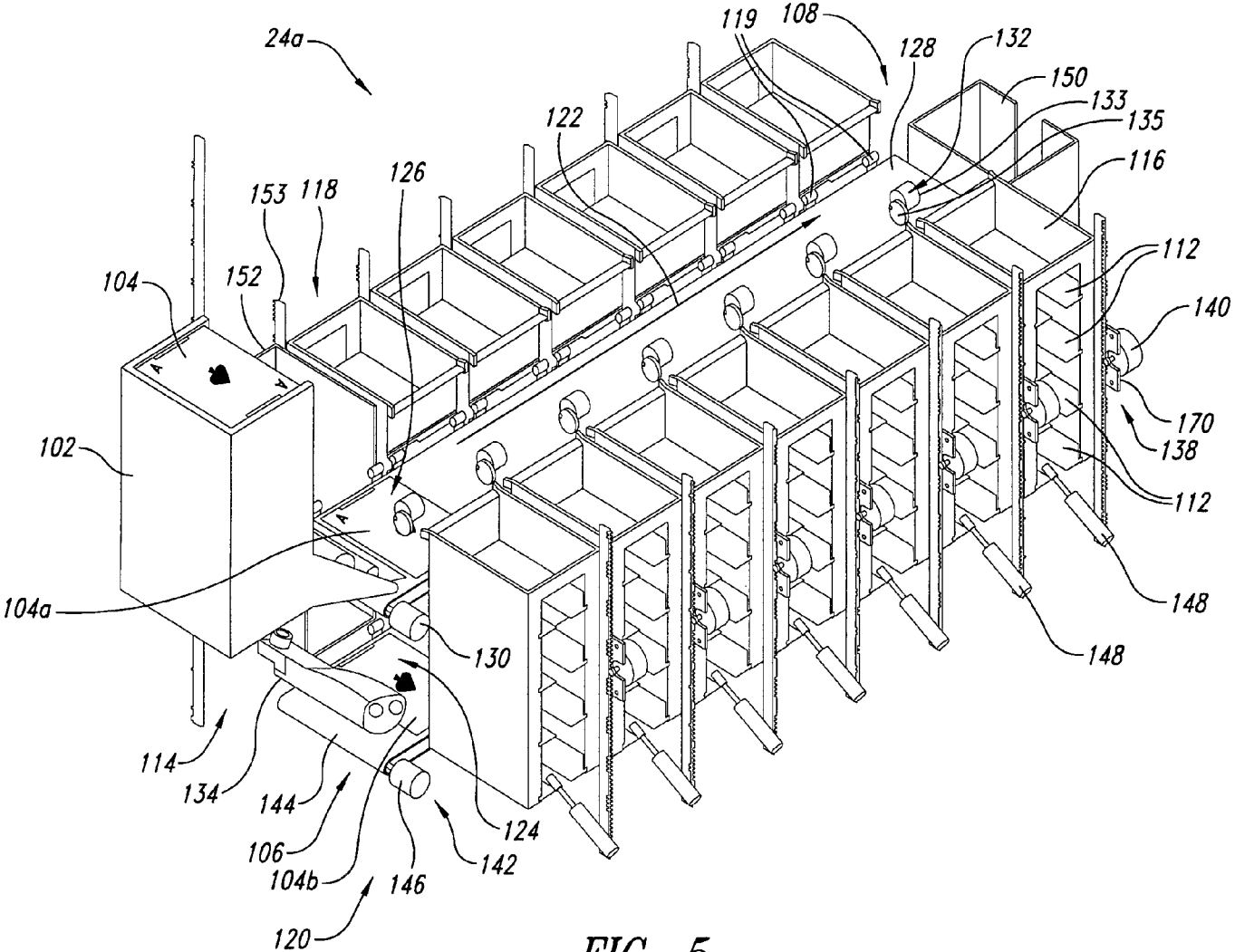
FIG. 5 is a front right top isometric view of another embodiment of a card distribution device in the form of one illustrated embodiment of a shuffling mechanism of a card shuffling device comprising storage receptacles, a transport mechanism and an interface couplable to receive a computationally generated sequence of numbers related information identifying playing cards, particularly suit for use with the automatic wager monitoring system of FIG. 1.

FIG. 5 shows another embodiment of the card distribution device 24, in the form of a second card shuffling device 24*b*. The second card shuffling device 24*b* generally includes the elements of the first card shuffling device 24*a*, but places a portion or all of the control system 110 (FIG. 4A) externally from the housing 100 (FIGS. 1 and 2). For example, the functionality of the control system 110 may be implement at least in part in at least one of the host computing system 12, gaming processor 86 and/or server computer 14. Communications may be via the LAN 78 or WAN/INTERNET 80.

As one example of such distributed functionality, the host computing system 12, gaming processor 86 and/or server computer 14 may generate the playing card sequence (e.g., pseudo-random, non-pseudo-random, or partially pseudo-random) and provide the playing card sequence to the microprocessor 154 in the card shuffling device 24*b*. In such an embodiment, the microprocessor 154 may be dedicated to collecting input, processing the input and controlling the various motors and actuators. This allows the playing card sequence generation function to be moved from the casino floor to a more secure area, increasing security of the system. This may also permit the elimination of the second microprocessor or ASIC 160 and/or use of a less complex lower cost microprocessor 154 in the card shuffling device 24*b*. Thus, the number of microprocessors dedicated to producing playing card values (e.g., pseudo-random numbers, non-pseudo-random number, partially pseudo-random numbers) may reduced by sharing the playing card value producing microprocessor 160 between multiple card shuffling devices 24*b* over a suitable network 78, 80.

Consequently, the card shuffling device 24*b* is particularly suited for use with the networked automated wager monitoring system 10 of FIG. 1. Thus, the card shuffling device 24*b* provides an integrated networked device for distributing playing cards in a computationally generated sequence.

The card shuffling device 24*b* also reads the playing cards 108 in the card receiver 102 or on the input or output conveyer 126, 142, allowing the tracking of playing and wagering according to methods described in commonly assigned U.S. patent applications: Ser. No. 60/130,368, filed Apr. 21, 1999; Ser. No. 09/474,858, filed Dec. 30, 1999, entitled "METHOD AND APPARATUS FOR MONITORING CASINOS AND GAMING"; Ser. No. 60/259,658, filed Jan. 4, 2001; Ser. No. 09/849,456, filed May 4, 2001; and Ser. No. 09/790,480, filed Feb. 21, 2001, entitled "METHOD, APPARATUS AND ARTICLE FOR EVALUATING CARD GAMES, SUCH AS BLACKJACK".

Verification/Outcome Determination

The card shuffling devices 24*a*, 24*b* may verify that the cards collected after play match the cards that were dealt in both identity and sequence. The card shuffling devices 24*a*, 24*b* may further determine the outcome of a game or hand, for example, determining the initial cards and any hit cards for each of the players 26 and the dealer 30. Further, the card shuffling devices 24*a*, 24*b* may determine whether the dealer 30 has blackjack at anytime, even before the playing cards are dealt. Many of these aspects are discussed in more detail in the patents and patent applications that are incorporated by reference herein. Even further, the card shuffling devices may reconstruct games after they are played, for example when a payout is contested after the playing cards are collected, or when there has been suspicious activity at one or more gaming tables 18. Additionally, the card shuffling devices 24*a*, 24*b* automatically reuses playing cards 104, reducing casino costs.

Playing Cards

Figure 6:
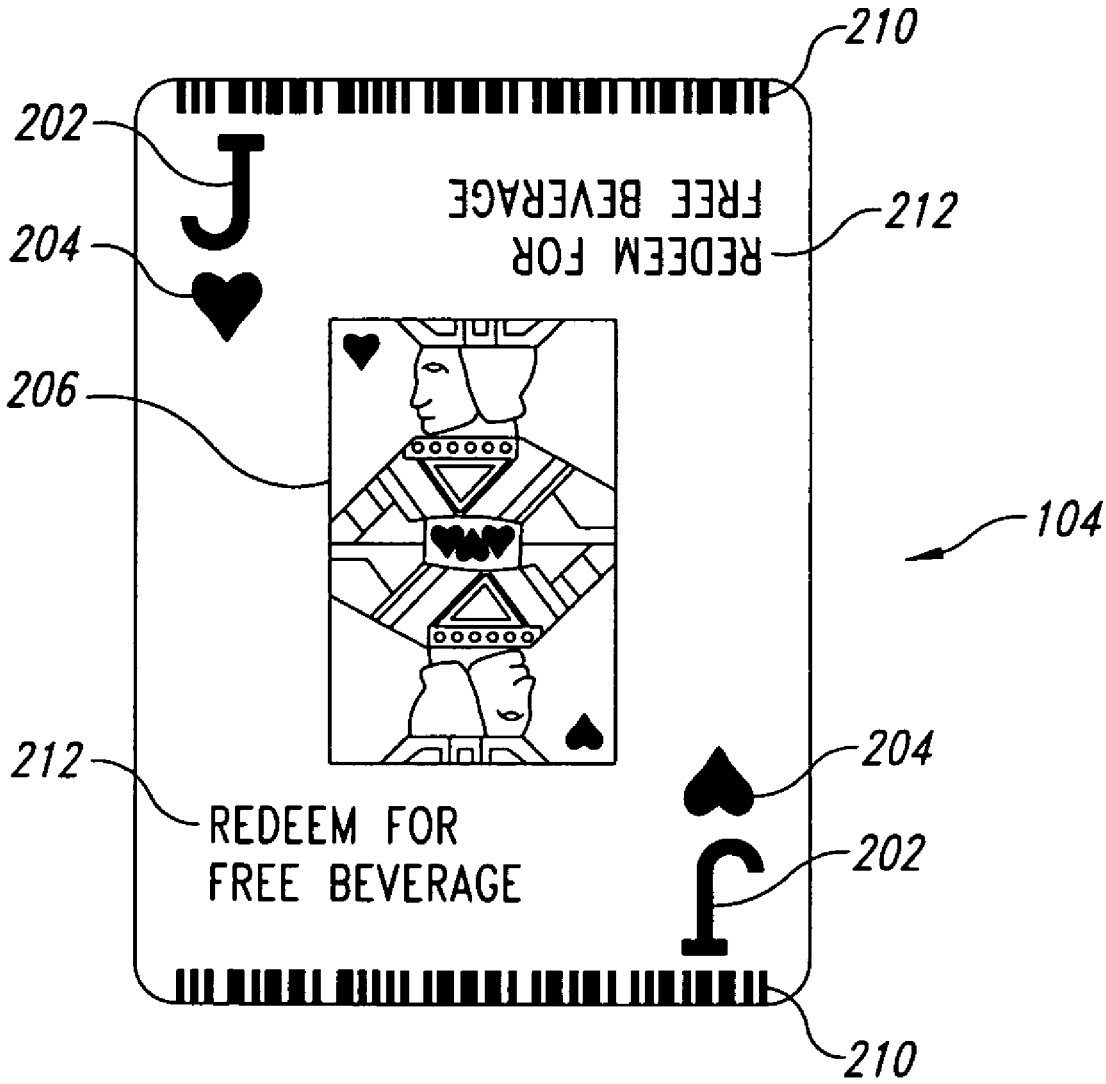
FIG. 6 is a front elevational view of a face of an exemplary playing card.

FIG. 6 shows various markings on the playing cards 104, including the conventional symbols representing a rank (i.e., 2-10, Jack, Queen, King, Ace) 202 and a suit (i.e., Diamonds, Hearts, Spades and Clubs) 204 of the playing card. The markings can also include indicia such as the images of Jacks, Queens and Kings 206 commonly found on playing cards.

The markings may also include an identifier, for example a serial number that uniquely defines the particular playing, and/or playing card deck to which the playing card belongs. The identifier can take the form of a bar code, area code or stack code symbol 210 selected from a suitable machine-readable symbology, to allow easy machine recognition using standard readers. While visible in the illustration, the bar code symbols 210 can be printed with an ink that is only visible under a specific frequency of light, such as the UV range of the electromagnetic spectrum. This prevents players 26 from viewing the serial numbers during game play.

The markings can optionally include additional indicia such as advertising messages 212. The advertising messages 212 may be player or game specific, and may be provide to only specific players, to random players, and/or to all players. The advertising message 212 may take the form of promotions, for example, informing the player that the card may be redeemed for meals, beverages, accommodations, souvenirs, goods and/or services at casino facilities or other facilities. The inclusion of a serial number on the playing card, particularly a serial number encoded in machine-readable form 212 allows a promotional playing card of the playing cards 104 to be easily verified using standard automatic data collection ("ADC") devices when presented for redemption.

Card Shuffling Device Operation

The card shuffling device 24*a* may employ at least two distinct approaches. In a first approach, the playing cards 104 are sorted into card holders 112 by at least one of rank and/or suit, and are removed from the card holders 112 based on the generated playing card sequence (pseudo-random sequence, non-pseudo-random sequence, or partially pseudo-random sequence). In a second approach, the playing cards 104 are sorted into playing card sequence before or as they are placed in the card holders 112, then the playing cards are sequentially removed from the card holders 112.

Loading/Preparing Card Shuffling Device

Figure 7A:
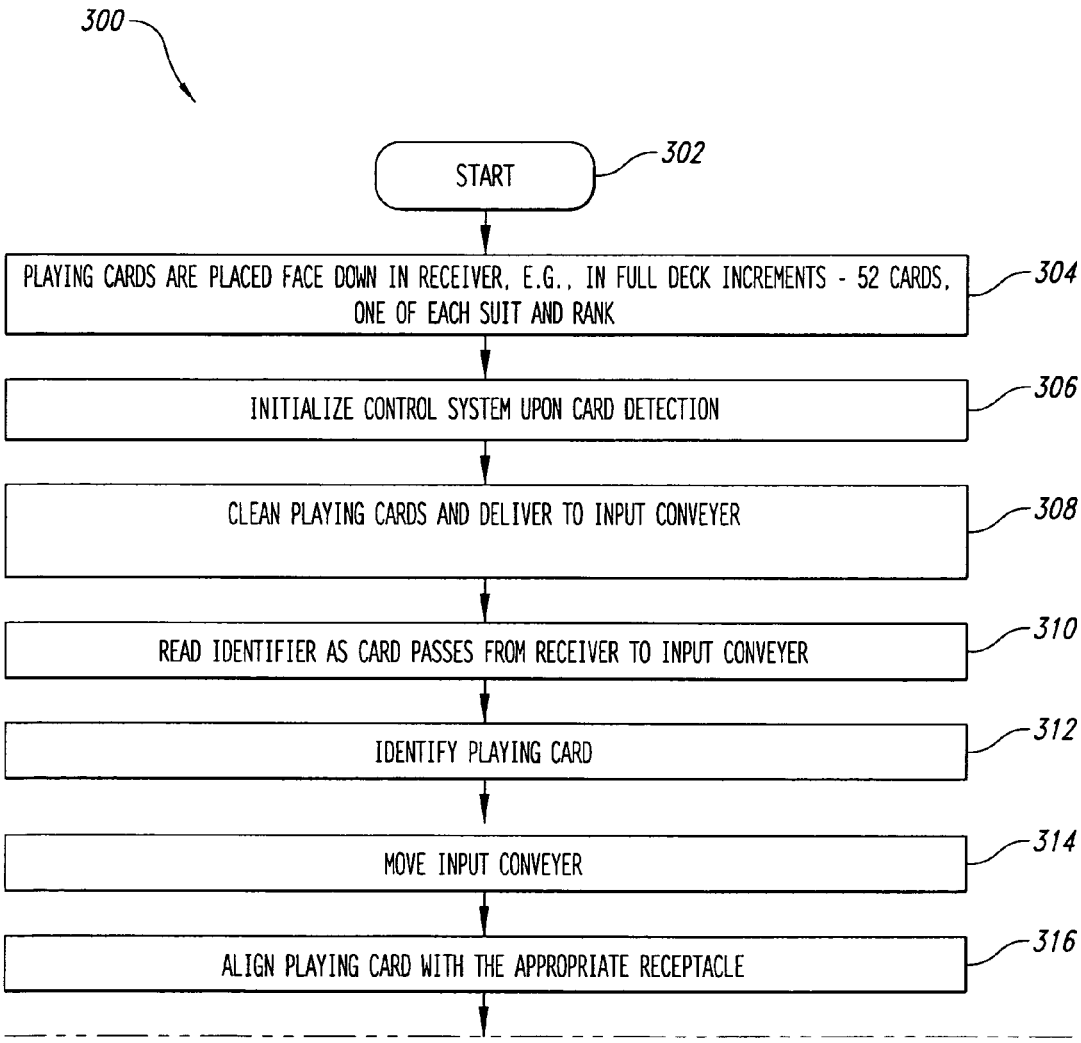
FIGS. 7A and 7B are a flow diagram showing a method of loading and preparing the playing card shuffling device of FIGS. 4A-4D according to one embodiment.
Figure 7B:
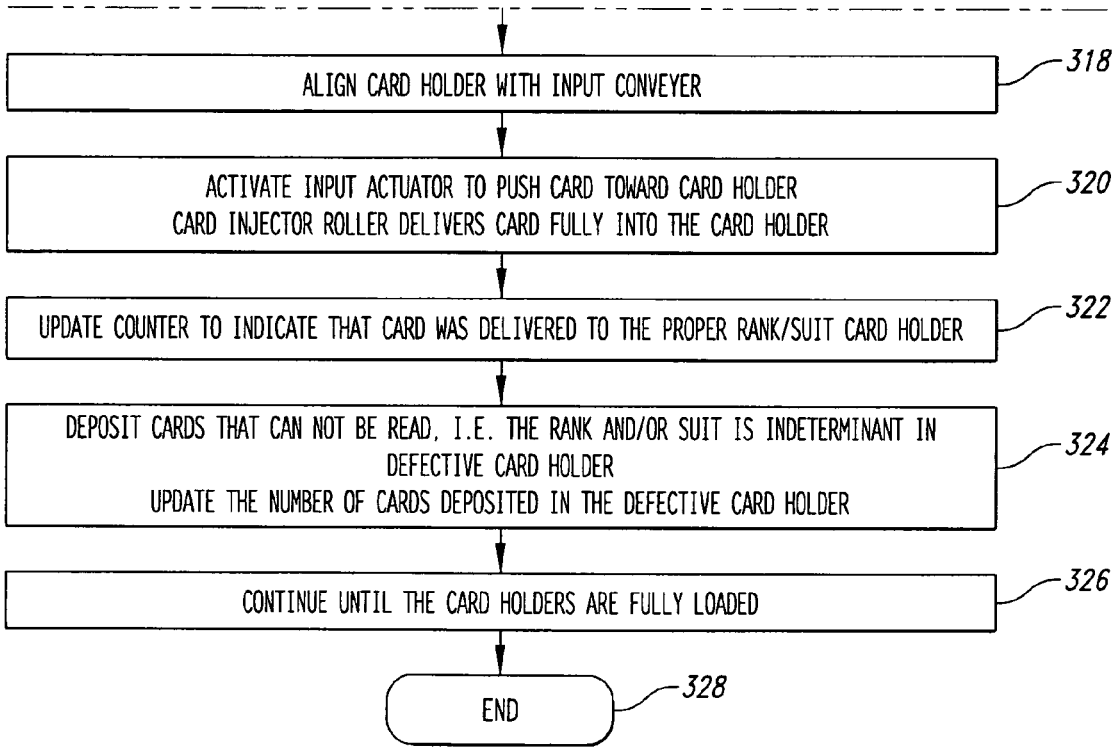

FIGS. 7A and 7B show a method 300 of loading and preparing the playing card shuffling device 24*a* of FIGS. 4A-4D according to the first approach, starting in step 302. While discussed below in terms of operation via one or more microprocessor 154, 160 positioned locally at the playing shuffling device 24*a*, an appropriately configured card shuffling device 24*b* may be operated at least in part via one or more microprocessors located remotely from the card shuffling device 24*b*.

At 304, the card receiver 102 receives a plurality of playing cards 104 in a face down orientation. Note, the playing cards 104 are illustrated in face up orientation for ease of recognition in the Figures. The playing cards 104 may, for example, be loaded in full deck increments (i.e., 52 playing cards, of ranks 2-10, Jack, Queen, King, Ace, and four suits Club, Diamond, Hearts, Spades).

At 306, the control system 110 initializes upon detecting playing cards 104 in the card receiver 102. A position sensor in the card receiver 102 may detect the playing cards 104. Initializing may, for example, include returning all card holders 112 to a starting or "reference" position. Initializing may, for example, additionally or alternatively include running diagnostics in the background to monitor operation of the card shuffling device 24*a*.

At 308, the card cleaning mechanism 136 wipes or otherwise cleans individual playing cards 104*a* as the playing cards 104 are feed from the card receiver 102 to the input conveyer 126. The playing cards 104 may, for example, be gravity feed from the card receiver 102, or the card shuffling device 24*a* may employ a feed mechanism such as one or more driven rollers and/or belts.

At 310, the card reader 134 reads one or more identifiers from individual playing cards 104*a* as the playing cards 104 reach the input conveyer 126. In one embodiment, the card reader 134 images at least one barcode symbol 210 (FIG. 6) printed on the playing card 104*a* in an ink that is not visible to humans. The barcode symbol 210 encodes an identifier such as a serial number that identifies at least a rank of the playing card 104*a*. The barcode symbol 210 may further identify a suit of the playing, and/or may take the form of an identifier that is unique across multiple decks of cards (e.g. unique across hundreds or thousands of decks of playing cards). One skilled in the art will recognize the rank and suit markings 154, 156 could be read, however the machine-readable symbols are typically easier to process with existing hardware and software.

At 312, the microprocessor 154 identifies the playing card 104*a* based on identifier captured by the card reader 134, and determines the appropriate receptacle 116 and/or card holder 112. The microprocessor 154 or other processor such as a DSP, identifies the playing card 104*a* by processing the identifiers encoded in the read machine-readable symbols 210. The microprocessor 154 can employ methods and apparatus taught in commonly assigned U.S. patent applications U.S. patent applications: Ser. No. 60/130,368, filed Apr. 21, 1999; Ser. No. 09/474,858, filed Dec. 30, 1999, entitled "METHOD AND APPARATUS FOR MONITORING CASINOS AND GAMING"; Ser. No. 60/259,658, filed Jan. 4, 2001; Ser. No. 09/849,456, filed May 4, 2001; and Ser. No. 09/790,480, filed Feb. 21, 2001, entitled "METHOD, APPARATUS AND ARTICLE FOR EVALUATING CARD GAMES, SUCH AS BLACKJACK". Optionally, the microprocessor 154 may verify that complete decks are loaded into the card receiver 102, and may count the number of decks loaded. The microprocessor 154 may further verify that all of the loaded playing cards come from approved or authorized decks. In this respect, authorizing information may be encoded into the identifiers, and may even be encrypted to enhance security.

At 314, the microprocessor 154 continuously drives the input conveyer 126. The microprocessor 154 may cause the input conveyer 126 to move in increments equal to the width of a standard playing card in order to ensure alignment with the receptacle 116. Alternatively, smaller increments may be employed. For example, a stepper motor 130 and motor controller 162*a* may implement a defined number of discrete steps which in total equal to width of a standard playing card 104*a*. In a further alternative, the microprocessor 154 may signal the motor 130 via the motor controller 162*a*, to perform a defined number of steps which corresponds to a distance between the location of the playing card 104*a* on the input conveyer 126 and the receptacle 116 corresponding to the identified rank of the playing card 104*a*. Thus, the microprocessor 154 produces control signals to cause the input conveyer 126 to move the playing card 104*a* along the card input path 122 until the playing card 104*a* is aligned with the appropriate receptacle 116, as illustrated at 316.

At 318, the microprocessor 154 also produces control signals to cause the appropriate card holder 112 to align with the input conveyer 126, for example, by driving a motor 140 to move a rack and pinion 138. This may be performed simultaneously with the movement of the playing card 104*a* along the input conveyer 126 with respect to the receptacles 116. Thus, the control system 110 may employ the rank and suit determination to minimize the time required to deliver the playing cards 104 to their proper storage locations (i.e., card holders 112), by optimizing the position with respect to the seven positions of receptacles 116 along the input conveyer 126 along with simultaneous positioning of the different card holders 112 with respect to the input conveyer 126.

Once aligned, the microprocessor 154 produces control signals to cause an appropriate one of the card input actuators 132 to move the playing card 104*a* toward the desired card holder 112, as illustrated at 320. A driven card injector roller and/or belt 119 advances the playing card 104*a* completely into the desired card holder 112 The card injector roller and/or belt 119 may be continuously driven during operation of the card shuffling device 24*a*. Alternatively, card injector roller and/or belt 119 may be driven in response to control signals from the microprocessor 154. For example, the microprocessor 154 may determine the based on calculations of position and/or a count of a number of steps performed by the motor 130. Additionally, or alternatively, the microprocessor 154 may rely on position information from one or more sensors.

At 322, the control system 110 updates a count of the number of playing cards 104 delivered to the particular card holder 1-12. For example, the control system 110 may include an electromechanical counter (not shown), that detects the entry of the playing card 104*a* into the card holder 112. Such an electromechanical counter may take any of a variety of forms, such as those discussed generally above. The counts for the various card holders 112 is preferably maintained in a static state or with sufficient backup such that these values will not be lost in the event of an intentional or unintentional loss of power to the card shuffling device 24*a*.

At 324, playing cards 104 that are not successfully read (e.g., rank and/or suit are indeterminate) or which have other defects (e.g., bends, slits, scratches, creases) are delivered to the defective card holder 150. The control system 110 updates a count of the number of playing cards 104 delivered to the defective card holder 150, for example, by use of an electromechanical counter (not shown), that detects the entry of the playing card 104*a* into the defective card holder 150.

At 326, the microprocessor 154 determines whether the card holders 112 are fully load, repeating the above acts until the card holders 112 are fully loaded or the desired number of playing cards have be stored. The card shuffling device 24*a* may have a variety of capacities. For example, the illustrated card shuffling device 24*a* may hold one hundred and four decks, where each deck includes fifty-two standard playing cards. The card shuffling device 24*a* may include fewer or greater number of playing cards. The method 300 then terminates at 328.

Sorting/Shuffling Playing Cards Based On Computationally Generated Sequence

Figure 8:
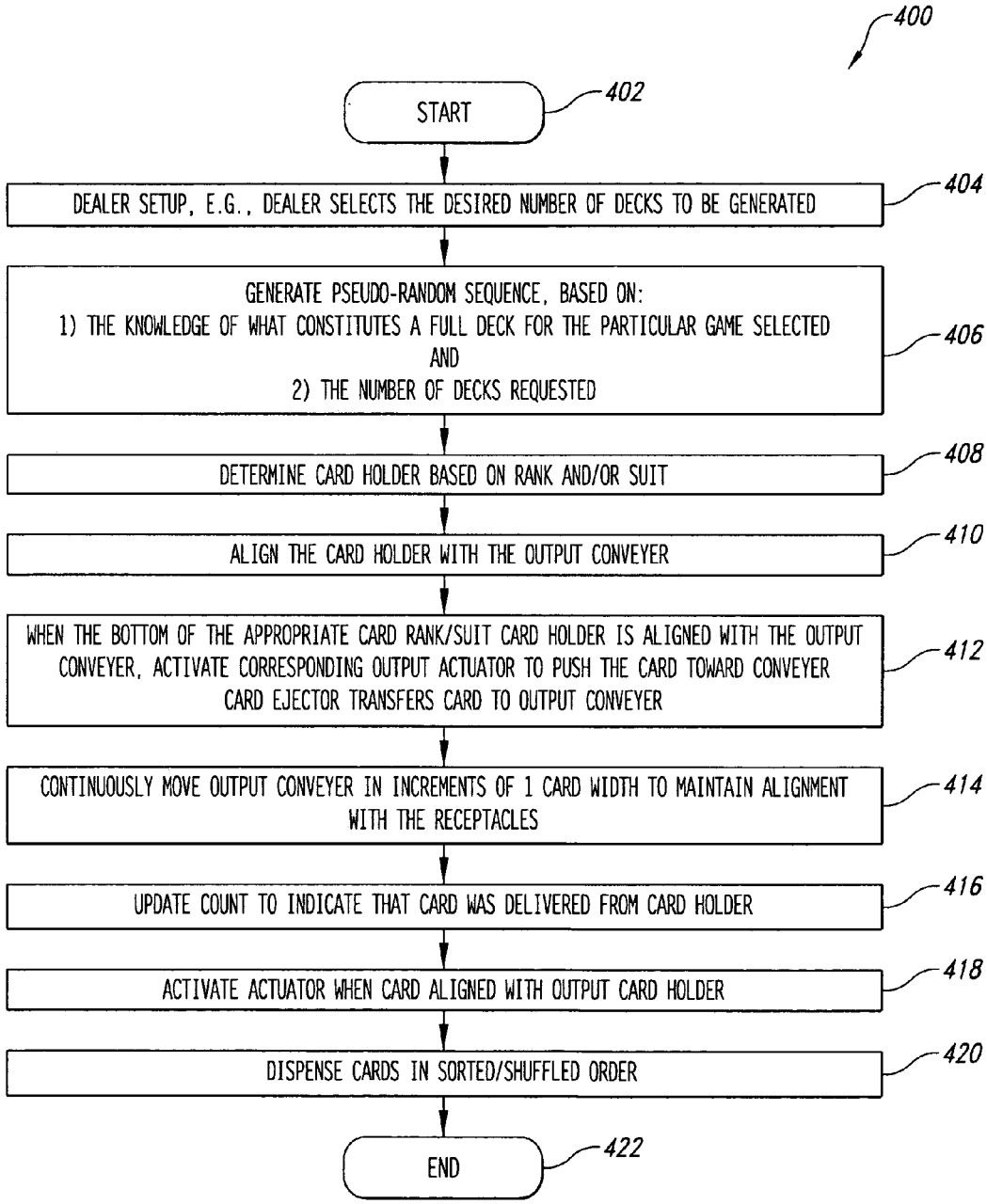
FIG. 8 is a flow diagram showing a method of operating the playing card shuffling device to sort or shuffle playing cards according to one embodiment.

FIG. 8 shows a method 400 of operating the playing card shuffling device 24*a* of FIGS. 4A-4D to sort or shuffle playing cards 104 according to the first approach, starting in step 402. While discussed below in terms of operation via one or more microprocessor 154, 160 positioned locally at the playing shuffling device 24*a*, an appropriately configured card shuffling device 24*b* may be operated at least in part via one or more microprocessors located remotely from the card shuffling device 24*b*. Further, while discussed below with reference to a computationally generated pseudo-random playing card sequence, the teachings may be applied to computationally generated non-pseudo-random playing card sequences and/or computationally generated partially pseudo-random playing card sequences, as discussed above.

At 404, the dealer 30 may make various selections via an interface with the control system 110 such as a dealer terminal, to generate one or more decks of playing cards 104 based on desired criteria. For example, the dealer 30 may select a desired number of playing card decks to be generated. Typically, games of blackjack will employ 1, 2, 6 or 8 full decks of playing cards. Variations of blackjack, as well as other games, may employ other numbers of full decks of playing cards, or even partial decks of playing cards. In some embodiments, the dealer 30 may select the type of game (e.g., blackjack, baccarat, five-card stud poker, Pai Kow poker, etc), or the type of game may be predetermined.

As part of act 404, the dealer 30 may optionally select a desired the casino advantage for the game, or such may be predefined. Typically, the casino advantage is dependent on a number of factors, including the type of card game, the particular rules employed by the casino for the type of card game, and the number of decks or cards from which the cards are dealt. In an alternative embodiment, the casino advantage may also depend on the composition of those playing card decks where, for example, certain playing cards are removed or added to the card decks (e.g., 5 Aces in one or more card decks; and/or only 3 Kings in one or more card decks), providing the opportunity for progressive, jackpot or enhanced payouts.

The microprocessor 154 may rely on a previously defined game type, game rules and number of decks, or may allow the dealer 30, or even the player 26, to select one or more of the parameters. For example, the dealer 30 may select the desired advantage and provide suitable house odds to the player 26 based on the advantage. Alternatively, the player 26 may select a set of desired house odds, and rely on the host computing system 12 to select the appropriate casino advantage corresponding to those house odds. Thus, the casino can offer the player 26 higher odds where the player 26 is willing to play against a hand dealt from a larger number of playing cards 108. The casino can also offer the player 26 higher odds where certain playing cards are omitted from one or more card decks. Additionally, or alternatively, the casino can offer the player higher odds or a bonus (e.g., jackpot, enhanced payout or progressive payout) for receiving a particular hand, such as 5 sevens. Where the dealer 30 optionally selects a desired the casino advantage, the control system 110 determines the number of decks of playing cards required to deal a game having the determined casino advantage.

At 406, the control system 110 responds by producing a pseudo-random sequence based at least in part on 1) a knowledge of what constitutes a full deck for the particular card game; and 2) the particular number of deck(s) selected. As discussed above, the microprocessor 154 or the microprocessor 160 may computationally generate the pseudo-random sequence. The microprocessor 154 or the microprocessor 160 may computationally generate the pseudo-random sequence for many playing cards all at once, or may computationally generate the pseudo-random sequence for each playing card one-at-a-time, for example, as the previous playing card 104*b* is withdrawn from the corresponding card holder 112.

The microprocessor 154 or the microprocessor 160 may computationally generate the pseudo-random sequence by pseudo-randomly generating values corresponding to playing cards 104. The playing card values can take any of a variety of forms which is capable of identifying each individual playing card, and which is convenient for computational use. For example, each playing card in a conventional deck can be assigned an integer value 1-52. Successive integers can be assigned where more than one card deck is used. For example, each playing card rank and suit combination in a second conventional deck can be assigned a respective integer playing card value from 53 to 104. The playing card rank and suit combinations in each "virtual" card deck may be in a matching predefined sequence. For example, the playing card value corresponding to the two of hearts combination may be 1 for the first deck and 53 for the second deck, while the playing card value for the Ace of spades may be 52 for the first deck and 104 for the second deck. Employing the same sequence for mapping the playing card values to the rank and suit combinations in multiple "virtual" card decks facilitates later card identification or recognition, while not hindering the generation of pseudo-random sequences. Methods of random number generation are well known in the computer arts so will not be described in detail. The random number generation employs a range initially including all of the determined playing card values. Thus, the control system 110 can generate a random sequence that is unaffected by mechanical consistencies of any device, or mechanical limitations on the total number of playing cards.

Typically, in generating the pseudo-random sequence, the microprocessor 154, 160 will employ one playing card value for every playing card rank and suit combination for each of the determined number of playing card decks (e.g., 52 playing card values per card deck). Thus, the control system 110 is working with "virtual" playing cards, or values representing playing cards in one or more "virtual" decks. The microprocessor 154 or the microprocessor 160 employs an algorithm to computationally generate the pseudo-random sequence, thus ensuring a truly the pseudo-random sequence that is not subject to the non-random distributions associated with purely mechanical shuffling systems. Additionally, or alternatively, the computationally generated pseudo-random sequence permits the number of decks from which the playing card sequence will be generated to be virtually unlimited.

At 408, the microprocessor 154 determines the card holder 112 corresponding to a next one of the pseudo-randomly generated values.

At 410, the microprocessor 154 produces control signals to move the determined card holder 112 into alignment with the output conveyer 142. In 412, the microprocessor 154 produces control signals to cause an appropriate one of the output actuators 148, to dispense the playing card 104*b* from the determined card holder 112 onto the output conveyer 142. The output actuator 148 releases the playing card 104*b* from the determined card holder 112 toward the output conveyer 142, where an optional driven ejector roller or belt 149 moves the playing card 104*b* completely onto the output conveyer 142.

At 414, the microprocessor 154 continuously drives the output conveyer 142. The microprocessor 154 may cause the output conveyer 142 to move in increments equal to the width of a standard playing card in order to ensure alignment with the receptacle 116. Alternatively, smaller increments may be employed. For example, a stepper motor 146 and motor controller 162*b* may implement a defined number of discrete steps which in total equal to width of a standard playing card 104*a*. In a further alternative, the microprocessor may signal the motor 146 via the motor controller 162*b*, to perform a defined number of steps which corresponds to a distance between the location of the playing card 104*a* on the output conveyer 142 and the receptacle 116 corresponding to the identified rank of the playing card 104*a*. Thus, the microprocessor 154 produces control signals to cause the output conveyer 142 to move the playing card 104*a* along the card output path 124 until the playing card 104*a* toward the output card holder 152, as illustrated at 316.

At 416, the control system 110 updates a count of the number of playing cards 104 delivered from the particular card holder 112. For example, the control system 110 may include an electromechanical counter (not shown), that detects the exit of the playing card 104*a* from the card holder 112. Such an electromechanical counter may take any of a variety of forms, such as those discussed generally above. The counts for the various card holders 112 is preferably maintained in a static state or with sufficient backup such that these values will not be lost in the event of a an intentional or unintentional loss of power to the card shuffling device 24*a*.

At 418, the playing cards 104*b* are deposited into the output card holder 152, for example, via one of the actuators 132, 148. The playing cards 104*b* are thus arranged in the pseudo-randomly generated sequence or order. Alternatively, the playing cards 104*b* may be provided one-at-a-time to a participant such as the dealer 30. As a further alternative, the playing cards 104*b* may be stacked in order toward a slot or chute formed at front of the card shuffling device 24*a*, similar to that commonly found in conventional card shoes, for removal one-by-one by the participant (e.g., dealer 30).

At 420, the microprocessor 145 determines that the desired set of cards is complete or the output card holder 152 is full, thus the playing card distribution device 24*a* provides the sorted or shuffled playing cards to the participant (e.g., dealer 30). For example, the microprocessor 154 may send control signals that cause the output card holder 152 to rise from the surface of the gaming table 18, for example via the rack and pinion 153 and associated motor. The dealer 30 may then remove the playing cards, and may deal the playing cards without further shuffling. Alternatively, the dealer 30 or other participant may remove the playing cards one-at-a-time from the card shuffling device 24*a*, or the card shuffling device 24*a* may eject the playing cards one-at-a-time. The dealer 30 may employ standard casino procedures with respect cutting and/or "burning" playing cards. The method 400 terminates at 422.

Reloading Operation During Play of Games/End of Games

Figure 9A:
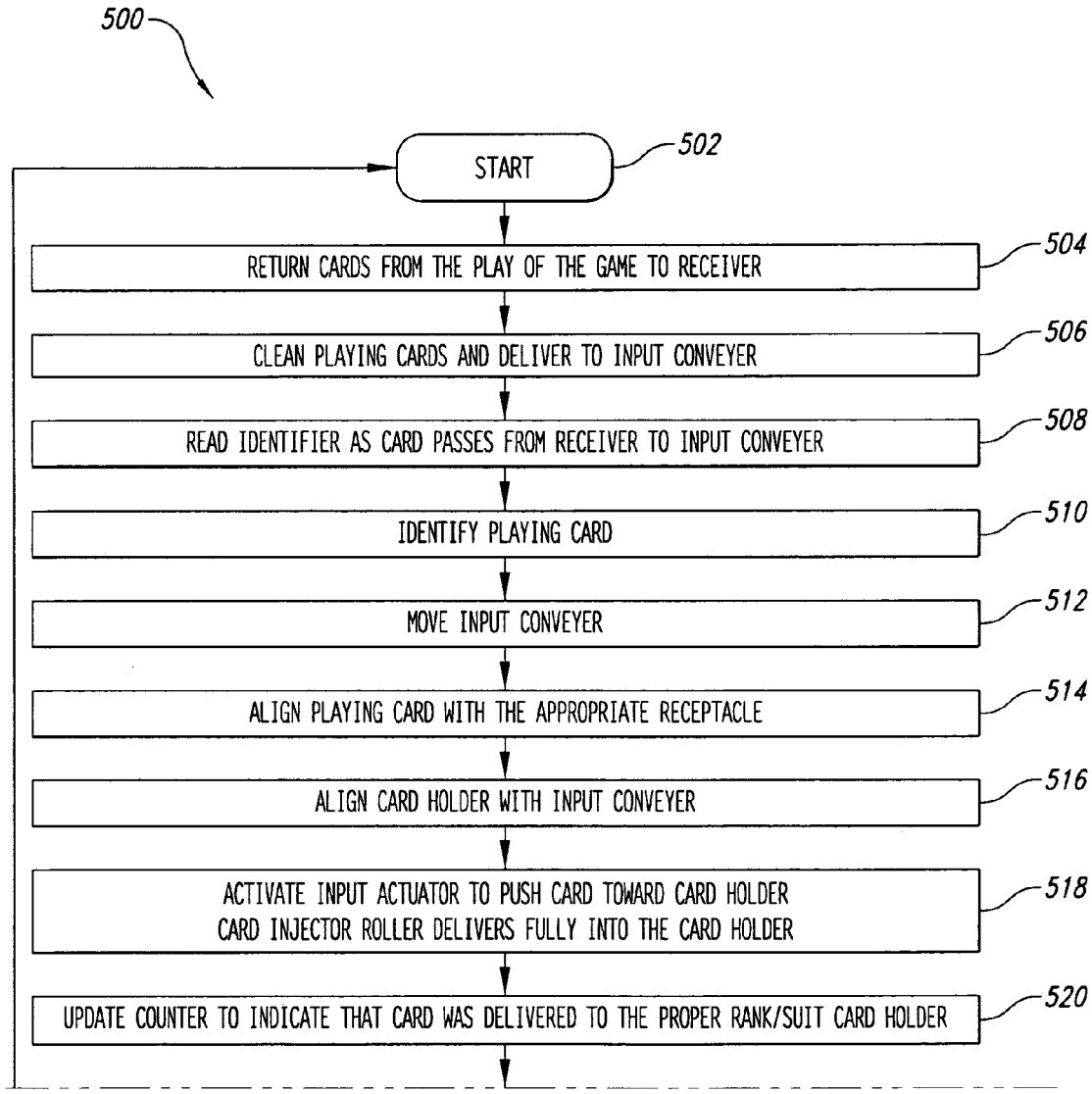
FIGS. 9A and 9B are a flow diagram showing a method of operating the playing card shuffling device during the play of one or more card games including reading and resorting playing cards collected at the end of a game or round according to one embodiment.
Figure 9B:
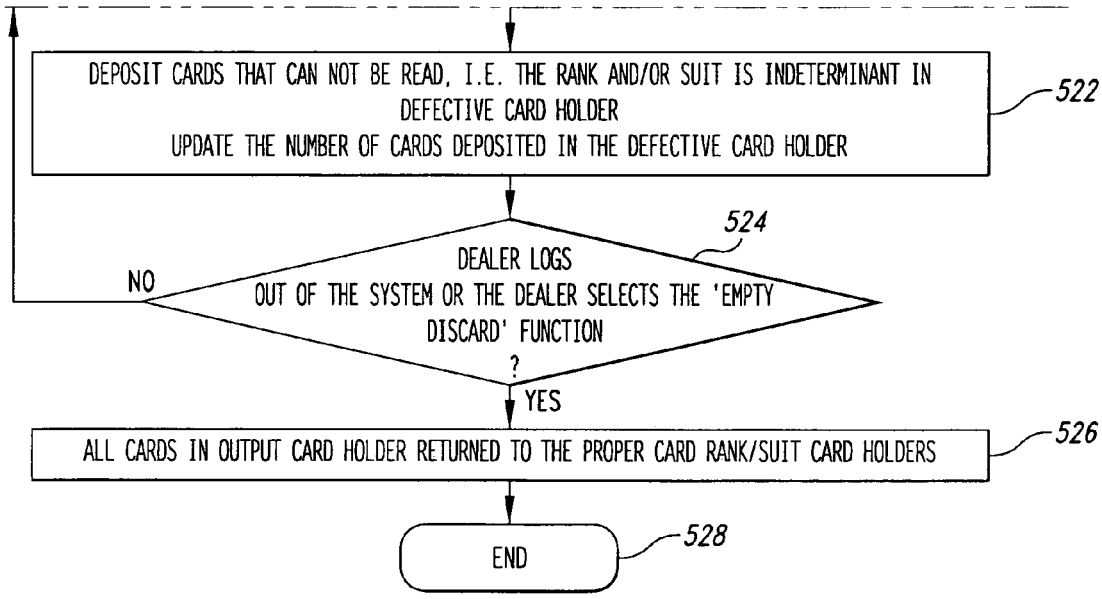

FIGS. 9A and 9B show a method 500 of operating the playing card shuffling device 24*a* of FIGS. 4A-4D during the play of one or more card games according to the first approach, starting in step 502. While discussed below in terms of operation via one or more microprocessor 154, 160 positioned locally at the playing shuffling device 24*a*, an appropriately configured card shuffling device 24*b* may be operated at least in part via one or more microprocessors located remotely from the card shuffling device 24*b*.

Many of the acts of method 500 are similar to the acts of method 300 (FIGS. 7A and 7B), and description of such will not be repeated in the interest of brevity and clarity.

At 504, the card receiver 102 receives a plurality of playing cards 104 in a face down orientation. Typically, the playing cards 104 were collected by the dealer 30 at the conclusion of a game or round. Thus, the card shuffling device 24*a* reuses playing cards, ensuring that the playing cards are sufficiently sorted or shuffled to avoid repeated patterns from being dealt or distributed.

At 506, the card cleaning mechanism 136 wipes or otherwise cleans individual playing cards 104*a* as the playing cards 104 are feed from the card receiver 102 to the input conveyer 126, in a similar manner to act 308 (FIGS. 7A and 7B). At 508, the card reader 134 reads one or more identifiers from individual playing cards 104*a* as the playing cards 104 reach the input conveyer 126, in a similar manner to act 310 (FIGS. 7A and 7B). At 510, the microprocessor 154 identifies the playing card 104*a* based on identifier read by the card reader 134, and determines the appropriate receptacle 116 and/or card holder 112, in a similar manner to act 312 (FIGS. 7A and 7B).

At 512, the microprocessor 154 continuously drives the input conveyer 126, in a similar manner to act 314 (FIGS. 7A and 7B). The microprocessor 154 produces control signals to cause the input conveyer 126 to move the playing card 104*a* along the card input path 122 until the playing card 104*a* is aligned with the appropriate receptacle 116, as illustrated at 514, similar to act 316 (FIGS. 7A and 7B). At 516, the microprocessor 154 produces control signals to cause the appropriate card holder 112 to align with the input conveyer 126, in a similar manner to act 318 (FIGS. 7A and 7B). At 518, the microprocessor 154 produces control signals at to cause an appropriate one of the card input actuators 132 to move the playing card 104*a* toward the desired card holder 112, in a similar manner to act 320 (FIGS. 7A and 7B). At 520, the control system 110 updates a count of the number of playing cards 104 delivered to the particular card holder 112, in a similar manner to act 322 (FIGS. 7A and 7B).

At 522, playing cards 104 that are not successfully read (e.g., rank and/or suit are indeterminate) are delivered to the defective card holder 150 and the control system 110 updates a count of the number of playing cards 104 delivered to the defective card holder 150, in a similar manner to act 324 (FIGS. 7A and 7B).

The method 500 may be continually performed until the microprocessor 154 determines at 524 that the dealer 30 has selected to either: 1) empty the, or 2) log out as, for example, via the dealer terminal. In either case, any playing cards remaining in the output card holder 152 are sorted into their proper card holders 112 according to rank and suit by the first card shuffling device 24*a* as illustrated at 526, as described below with reference to FIG. 10. The method 500 then terminates at 528.

Figure 10:
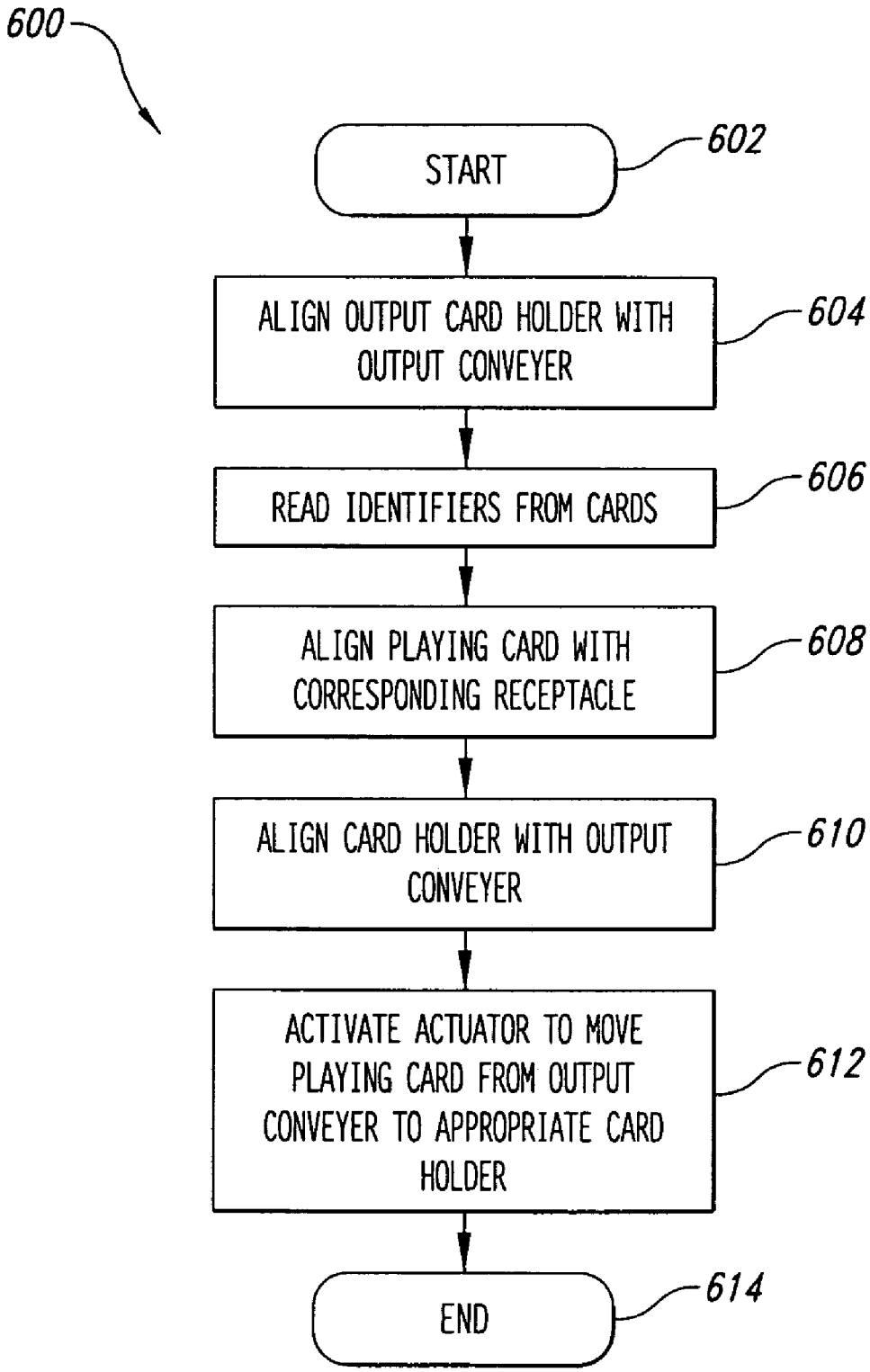
FIG. 10 is a flow diagram showing a method of operating the playing card shuffling device to return playing cards to the appropriate card holders in response to a dealer selection according to one embodiment.

FIG. 10 shows a method 600 of operating the playing card shuffling device 24*a* of FIGS. 4A-4D to return playing cards to the appropriate card holders 112 in response to a dealer selection according to the first approach, starting in step 602.

At 604, the microprocessor 154 produces control signals to move the output card holder 152 in alignment with the output conveyer 142. At 606, the reader 134 reads identifiers from the playing cards 104*b* as the playing cards 104*b* are returned to the output conveyer 142. At 608, the microprocessor 154 also produces control signals to move the output conveyer 142 with respect to the receptacles 116. At 610, the microprocessor 154 also produces control signals to move card holders 112 with respect to the output conveyer 142 so as to align a desired card holder 112 with the output conveyer 142 to receive a corresponding playing card 104*b* when the playing card 104*b* reaches the card holder 112. Once the playing card 104*b* is aligned with the corresponding receptacle and the card holder is aligned with the output conveyer 142, the microprocessor 154 provides control signals to the activate the output actuators 148 to move the playing card 104*b* into the corresponding card holder 112 at 612. The method 600 terminates at 614.

Thus, the microprocessor 154 sorts the playing cards into the card holders 112 based on rank and suit. Alternatively, the playing card shuffling device 24*a* may employ the input transport mechanism 118 rather than the output transport mechanism 120 for returning the playing cards 104 to the card holders 112.

In conjunction with the method 500 (FIGS. 9A and 9B), the microprocessor 154 may also determine that the set of playing cards has been sufficiently penetrated, for example, by monitoring the number of playing cards remaining in the card holders 112 or the number of playing cards collected in the defective card holder 520. This feature will typically not be required if a sufficiently large number of playing cards are employed.

Carousel Embodiment

Figure 11:
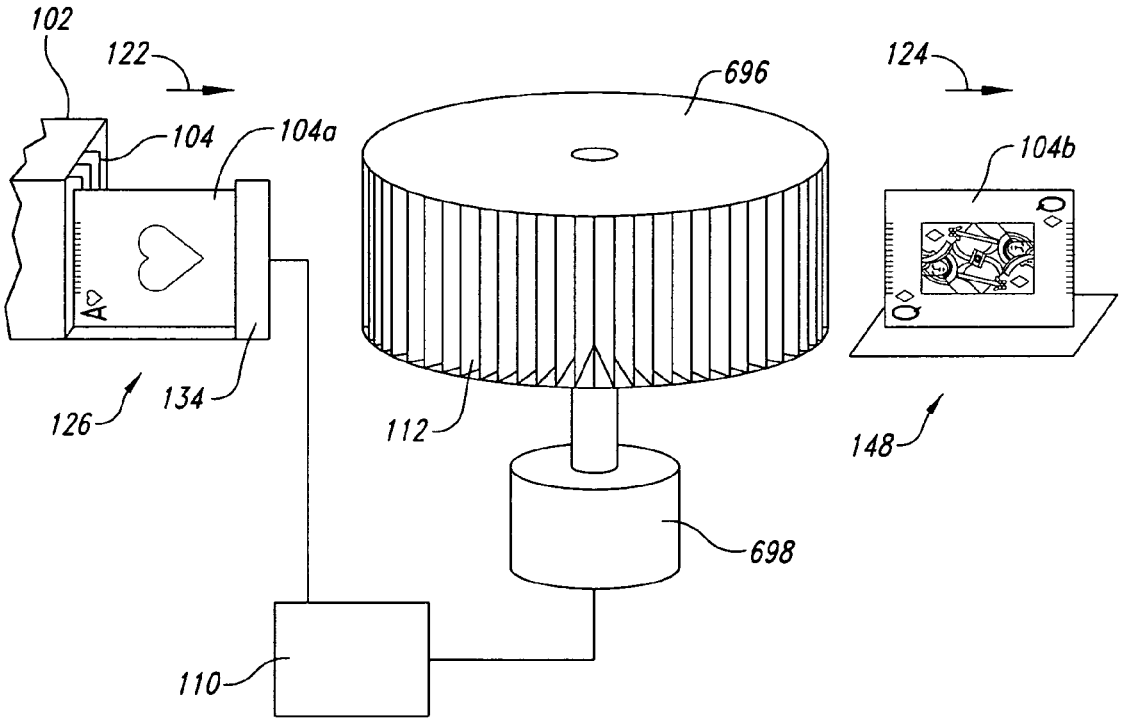
FIG. 11 is an isometric view of a card distribution device employing a carousel according to another illustrated embodiment.

FIG. 11 shows an alternative embodiment of a card distribution device 24 in the form of a card shuffling device 24*c* employing a carousel 696 to sort or shuffle playing cards 104 according to a computationally generated sequence such as a computationally generated pseudo-random sequence. Many of the elements are similar to those of the above described embodiments, so like reference numbers will be employed. Only significant differences in the structure and/or operation are discussed below.

The card shuffling device 24*c* includes a card receiver 102 sized to receive groups of playing cards 104 in a similar fashion to that discussed for the above described embodiments. An input conveyer 126 transports a playing card 104*a* along a card input path 122 from the card receiver 102 to the carousel 696. In particular, the carousel 696 includes a plurality of card holders 112 sized to hold individual or groups of playing cards 104. While shown as a single level of card holders 112, the carousel 696 may include multiple levels or cards holders 112, for example, one level for each suit, or the card shuffling device 24*c* may include multiple carousels 696.

A card reader 134 is positioned to read one or more identifiers from the playing card 104*a*, and is coupled to supply the identifying information to the control system 110. The control system 110 is coupled to control a motor 698, such as a stepper motor to position a selected one of the card holders 112 of the carousel 696 with respect to the input conveyor 126 to receive the playing card. As described below, the control system 110 may employ two different approaches in selecting the card holder 112 for the playing card 104*a*.

An output conveyer 142 transports a playing card 104*b* along a card output path 124 from the card holder to an exit or output card holder.

In one approach, the card shuffling device 24*c* functions in a similar manner to the first approach generally described above for the other embodiments, that is by sorting playing cards 104 into card holders 112 by rank and/or suit, and then distributing the playing cards in a determined order (e.g., computationally generated pseudo-random order).

Figure 12:
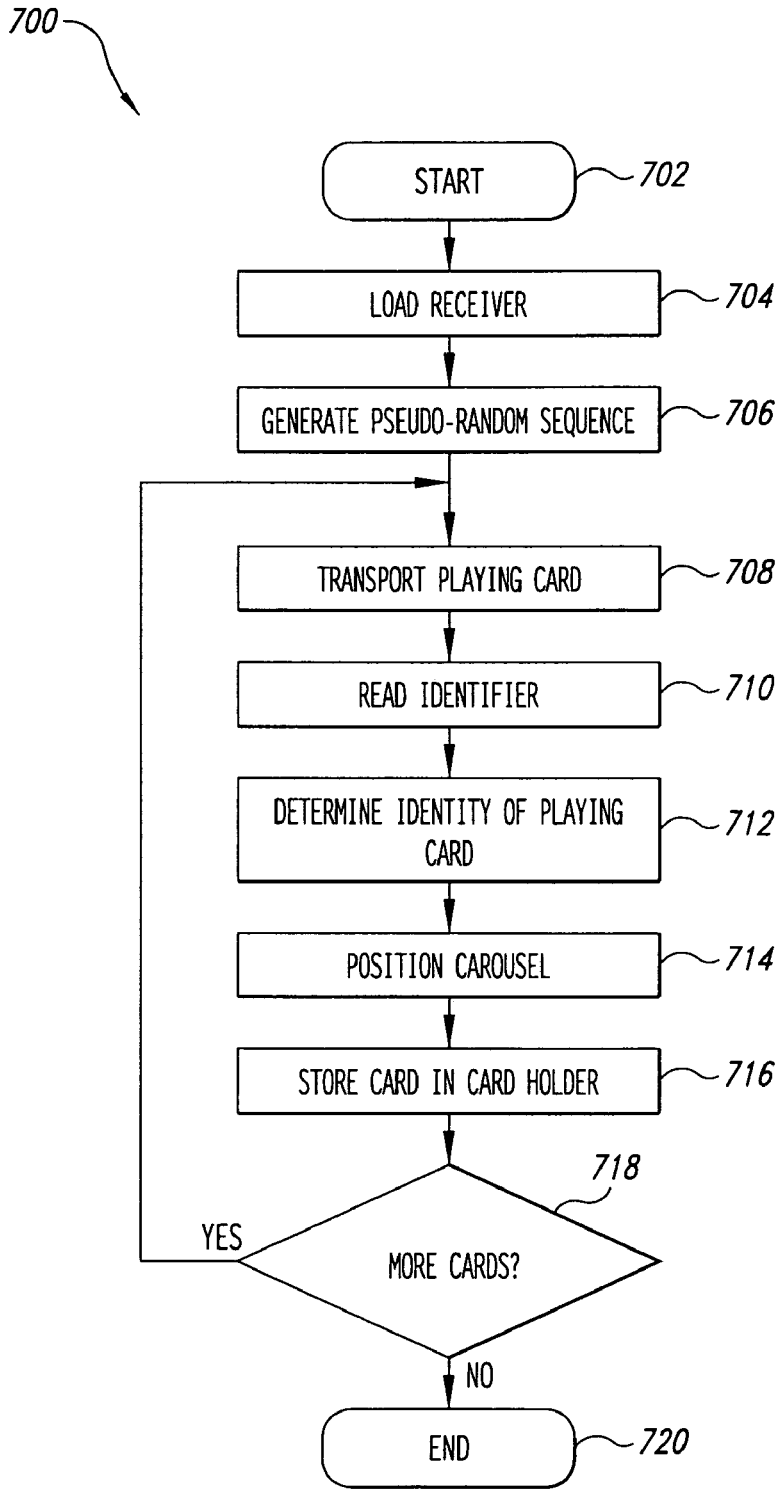
FIG. 12 is a flow diagram of a method of loading playing cards in a determined order according to one illustrated embodiment, suitable for use with the card distribution device of FIG. 11.
Figure 13:
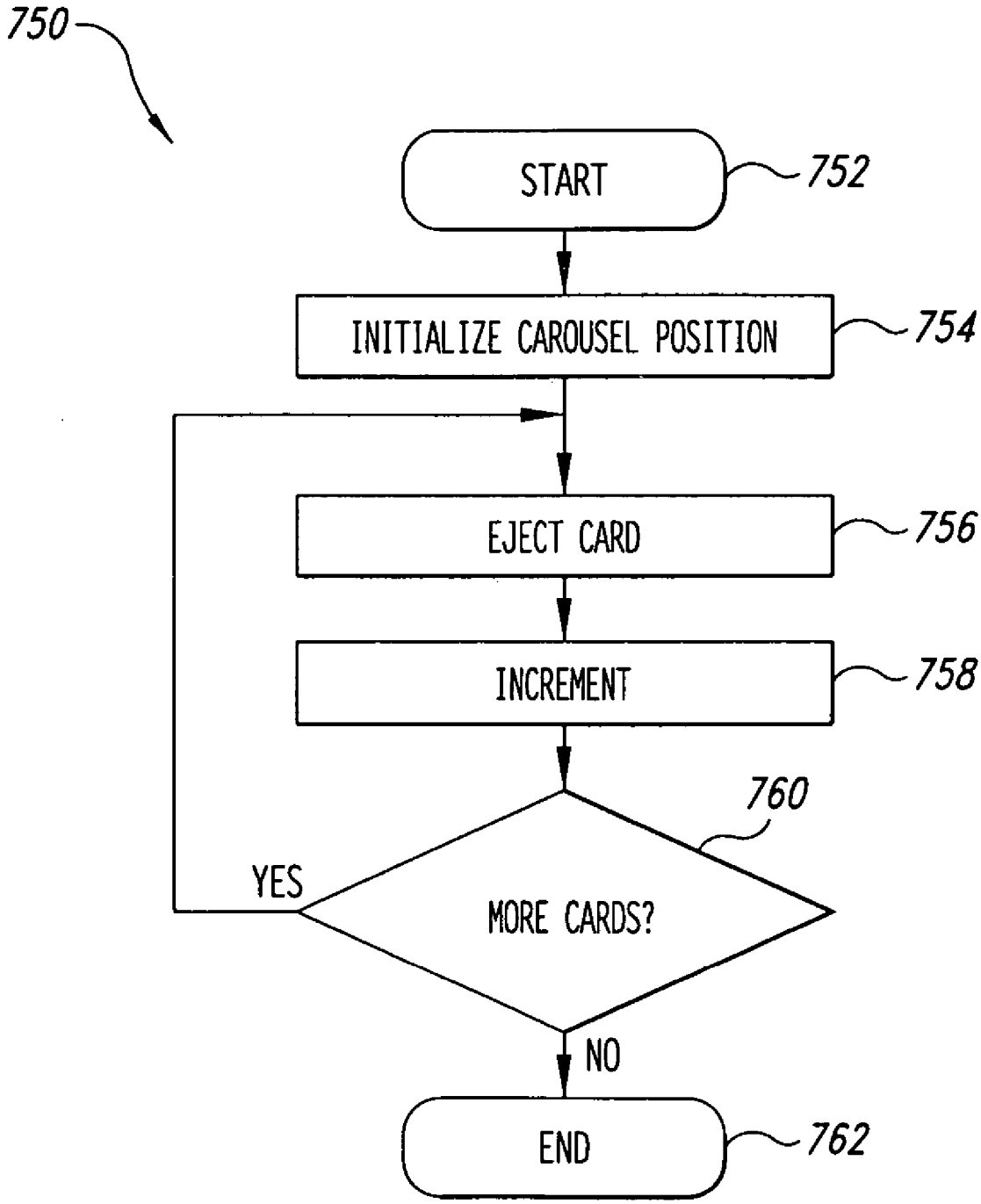
FIG. 13 is a flow diagram of a method of distributing playing cards previously sorted in a determined order, suitable for use with the card distribution device of FIG. 11.

A second approach illustrated in FIGS. 12 and 13, sorts the playing cards into the card holders 112 according to a determined order (e.g., computationally generated pseudo-random order), and then sequentially distributes the playing cards 104*b*.

FIG. 12 shows a method 700 starting at 702 of loading a playing cards 104 a determined order (e.g., computationally generated pseudo-random order) according to one illustrated embodiment, and will generally be discussed with reference to FIG. 11.

At 704, the receiver 102 is loaded with playing cards 104, for example, multiple full decks of playing cards 104. At 706, the microprocessor 154, 160 (FIG. 4A) generates a playing card sequence (e.g., pseudo-random sequence), as generally described above. At 708, the input conveyer 126 transports the playing card 104*a* toward the carousel 696. At 710, the card reader 134 reads one or more identifiers from the playing card 104*a*, and provides the read information to the control system 110. At 712, the control system 110 determines the identity of the playing card 104*a* from the identifying information. At 714, the control system provides control signals to the motor 698 to position a selected one of the card holders 112 with respect to the input conveyer 126. At 716, the input conveyer or associated elements of the input transport mechanism 118 position the playing card 104*a* into the selected card holder 112. At 718, the control system 110 determines if there are further playing cards 104 in the receiver 102, returning to 708 until the playing cards 104 are exhausted or the dealer instructions the control system 110 to stop operation. The method terminates at 720. Thus, playing cards 104 may be sorted into the carousel 696 in a computationally generated sequence or order, for example, a pseudo-random sequence or order.

FIG. 13 shows a method 750 starting at 752 of distributing playing cards 104 previously sorted in a determined order (e.g., computationally generated pseudo-random order) according to one illustrated embodiment, and will generally be discussed with reference to FIG. 11.

At 754, the control system 110 initializes a position of the carousel 696, for example, aligning a defined card holder 112 with the output conveyer 142. At 756, the output conveyer 142 or other elements of the output transport mechanism 120 ejects the playing card 104*b* from the selected card holder 112. At 758, the control system provides control signals to the motor 698 to increment the carousel 696 with respect to the output conveyer 142 to align a next sequential card holder 112 with the output conveyer 142. At 760, the control system 110 determines whether there are additional playing cards 104 in the carousel 696, returning to 756 if there are additional playing cards 104 in the carousel 696 or terminating at 762 if there are not additional playing cards 104 in the carousel 696.

Figure 14:
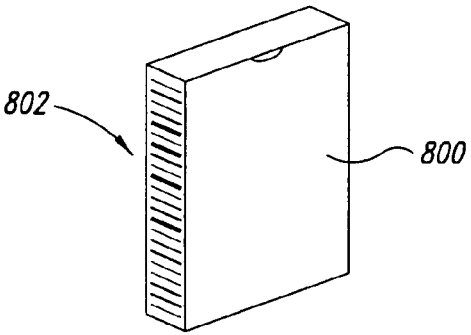
FIG. 14 is an isometric view of a package of playing cards, bearing at least one machine-readable symbol encoding information regarding the playing cards carried in the package.

FIG. 14 shows a package 800 of playing cards, the package 800 carrying a machine-readable symbol 802 encoding information regarding the playing cards in the package 800. The machine-readable symbol 802 may take the form of an optically readable barcode symbol, area or matrix code symbol or stacked symbol, selected from characters of a conventional symbology or a proprietary symbology. Machine-readable symbols may be optically read using readers such as scanners or imagers, which may be coupled to one or more elements of the automated wager monitoring system 10, discussed above. The machine readable symbol 802 may be printed directly on the package 800, or may be printed on a label 804 (FIG. 17) and adhered or otherwise coupled to the package 802. To enhance security, the machine-readable symbol 802 may be printed in an ink that is not visible to humans, such as an ink.

The machine-readable symbol 802 may encode information such as a probability at which the set of playing cards were generated. For example, the machine-readable symbol 802 may indicate the number of decks from which the set of playing cards in the package 800 was generated. Additionally, or alternatively, the machine-readable symbol 802 may indicate a probability of the set of playing cards including a jackpot, enhanced payout or progressive winning card combination. Additionally, or alternatively, the machine-readable symbol 802 may encode the sequence of the playing cards in the package 800. This may eliminate the need to read identifying information from the playing cards prior to dealing.

Figure 15:
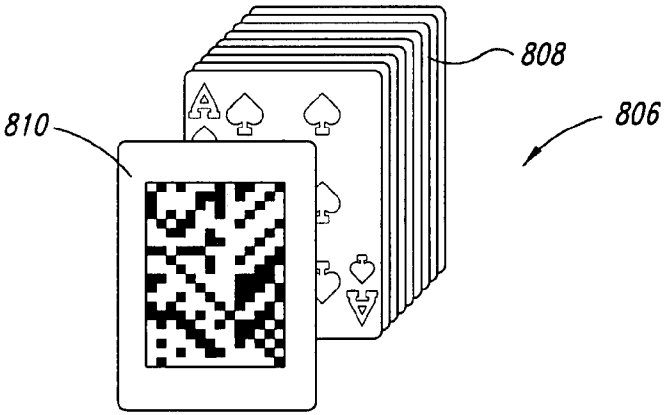
FIG. 15 is an isometric view of a set of playing cards, including at least one card bearing at least one machine-readable symbol encoding information regarding the playing cards in the set.

FIG. 15 shows a set of playing cards 806, including a number of standard playing cards 808, and a non-standard card 810 having the dimensions of a standard playing card however carrying a machine-readable symbol 802 instead of, or in addition to, standard playing card rank and suit markings. The machine-readable symbol can take any of the forms discussed above in reference to FIG. 14, and may encode some or all of the information discussed above in reference to FIG. 14. Placing the machine-readable symbol 802 on a card 810 rather than the package 800 may permit the machine-readable symbol 802 to be read by an scanner or imager located in a card shoe or other card holder. The card 810 may then be discarded as one of the "burned cards," or the card 810 may be retained and dealt where the card 810 includes standard rank and suit markings.

Figure 16:
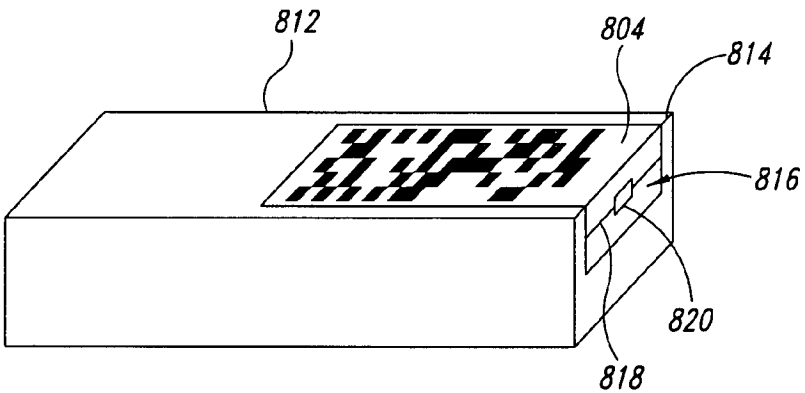
FIG. 16 is an isometric view of a package of playing cards, bearing at least one machine-readable symbol and one RFID device encoding information regarding the playing cards carried in the package.

FIG. 16 shows a package 812 carrying a relatively large set of playing cards (2-8 decks) suitable for use in a card distribution device 24 such as a card shoe, with or with reading electronics. The package 812 has an opening 814 which is sealed by a label 804. The label 804 bears a machine-readable symbol 802, as generally discussed above. The label 804 may also include a radio-frequency identification (RFID) transponder 816, including an antenna 818 and semiconductor device 820. As is generally know, the semiconductor device 820 is capable of storing information, and providing the stored information encoded in a wireless signal via the antenna 818. The RFID transponder 814 may be a passive device, relying on an RF interrogation signal to derive energy, or may be an active device relying on an label power source such as a battery (not shown).

The semiconductor device 820 may store the same or similar information as that stored in the machine-readable symbol 802, providing such information without the need for line-of-sight communications. Additionally, the semiconductor device 820 may encrypt the information (as stored and/or as transmitted), and may employ additional security measures such as requiring passwords to access the information. In some embodiments, the label 804 may eliminate the machine-readable symbol 804 or may limit the information encoded in the machine-readable symbol 804, relying on the RFID transponder for enhanced security.

The label 804 is located over the opening 814 to provide a visual indication that the package 812 has previously been opened. Additionally, the antenna 818 and/or semiconductor device 820 may be frangible, such that the RFID transponder 816 is rendered inactive once the package 812 has been open, breaking the label 804.

Figure 17:
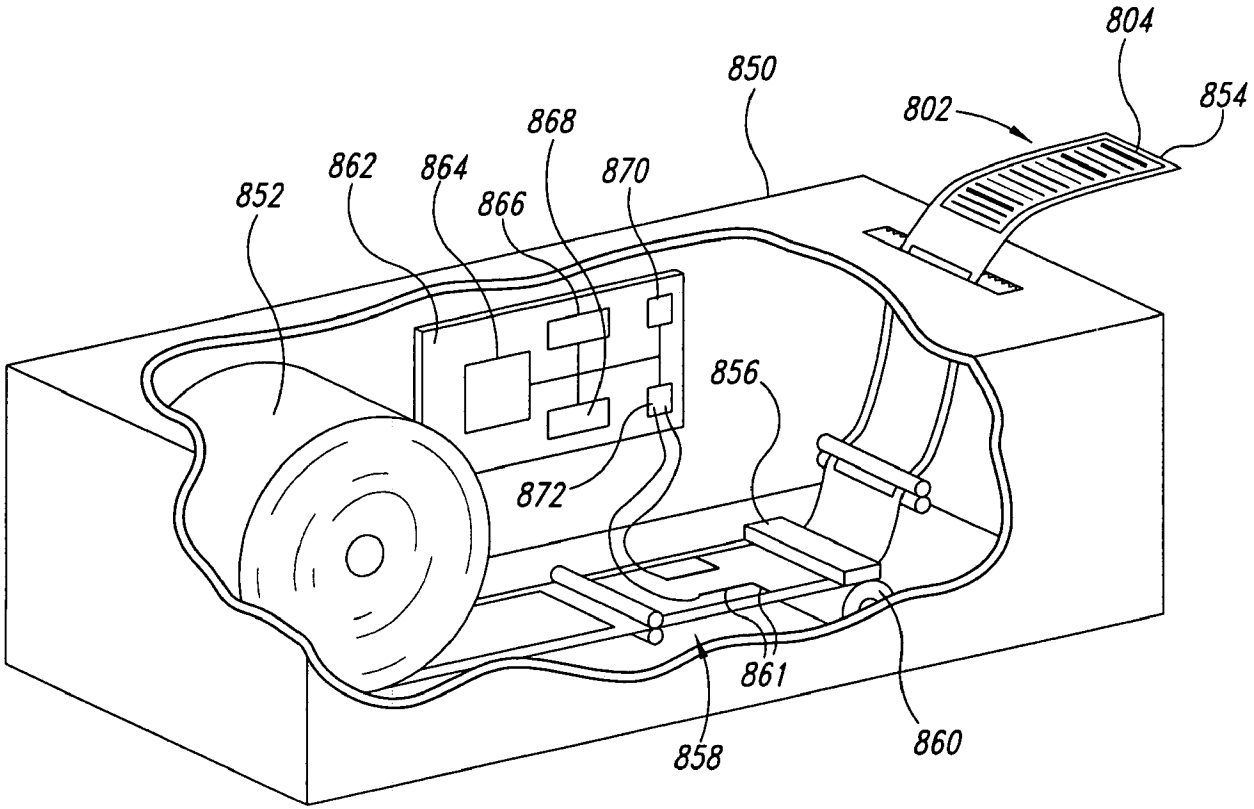
FIG. 17 is a partially broken isometric view of a printer and print media, the printer operable to print machine-readable symbols on labels or cards for encoding information regarding the playing cards.
Figure 18:
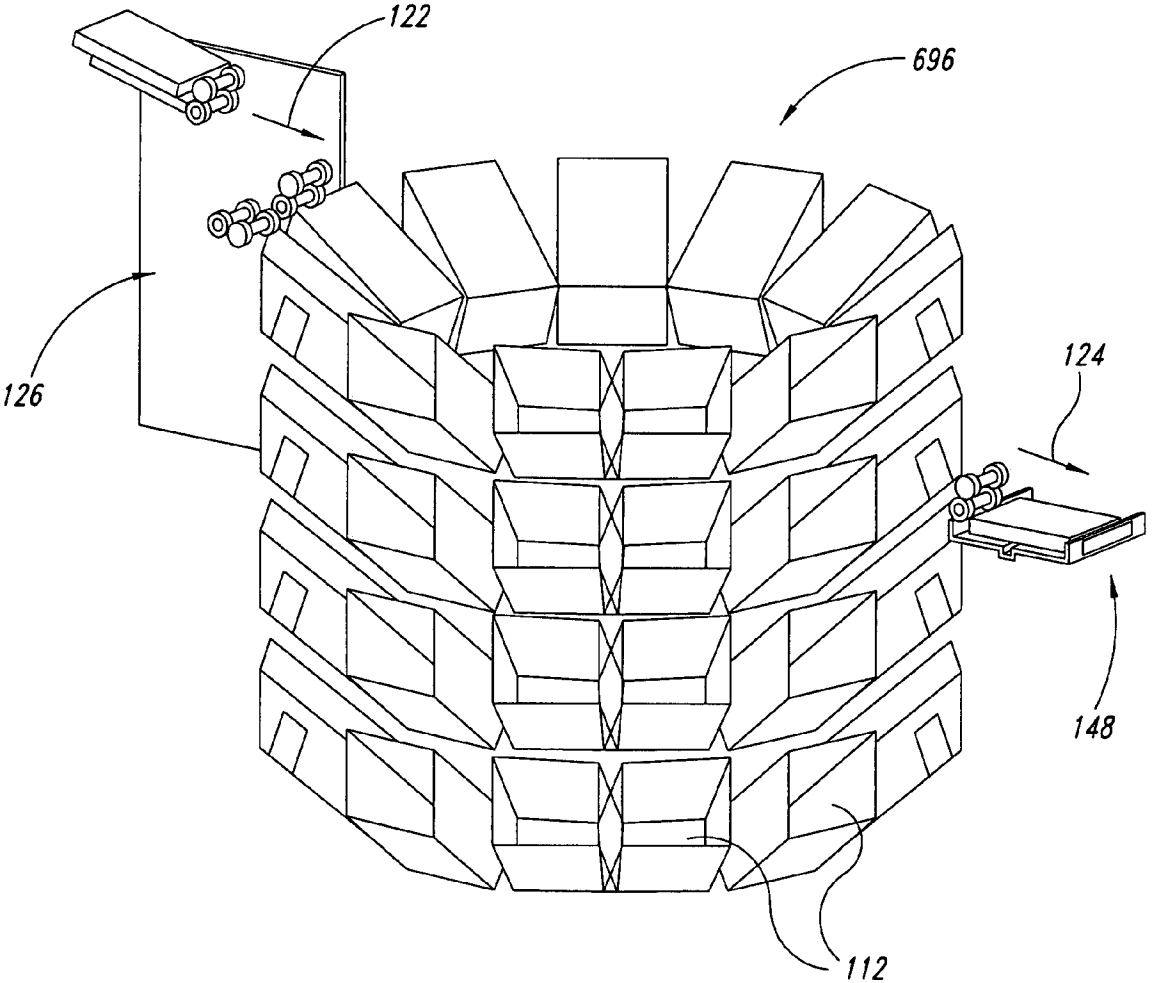
FIG. 18 is an isometric view of a card distribution device in the form of one illustrated embodiment of a shuffling mechanism comprising a carousel of storage receptacles, an input transport mechanism and an output transport mechanism according to another illustrated embodiment.
Figure 19:
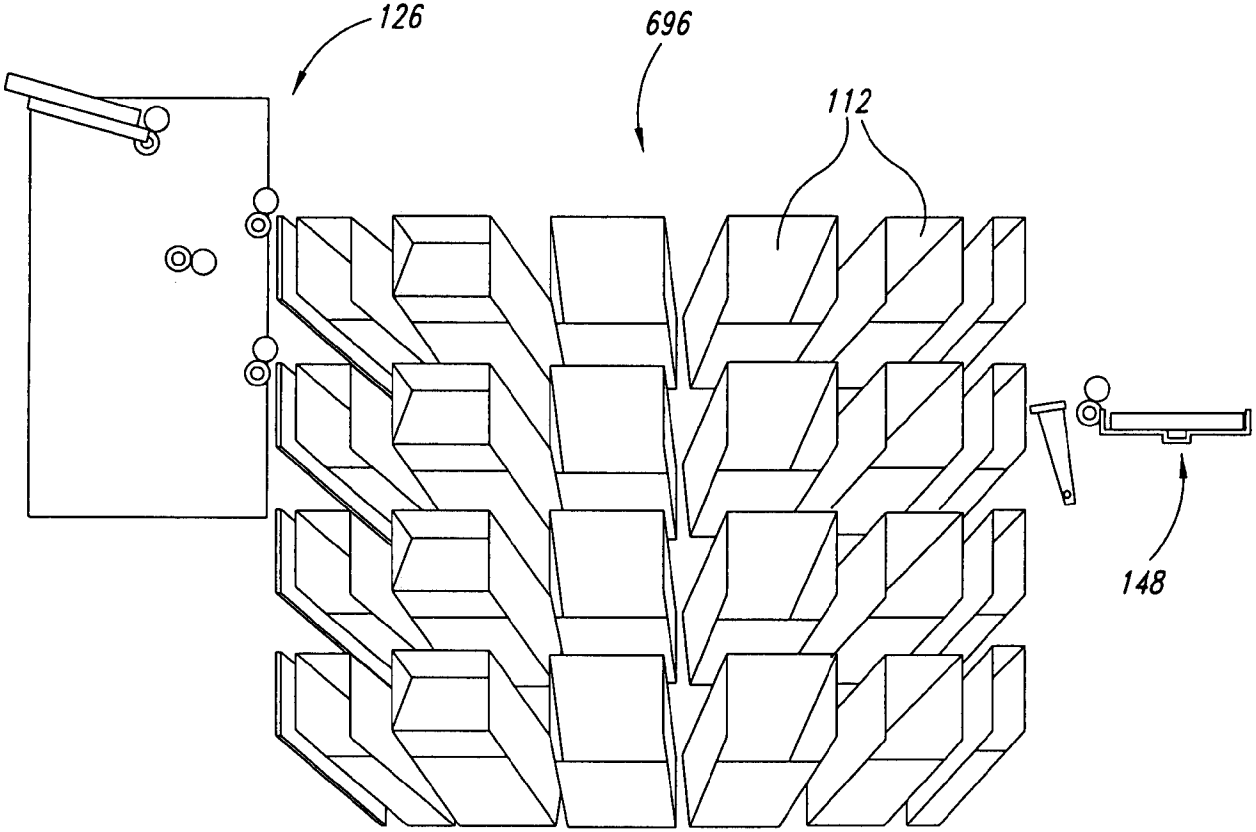
FIG. 19 is a side elevational view of a card distribution device of FIG. 18.
Figure 20:
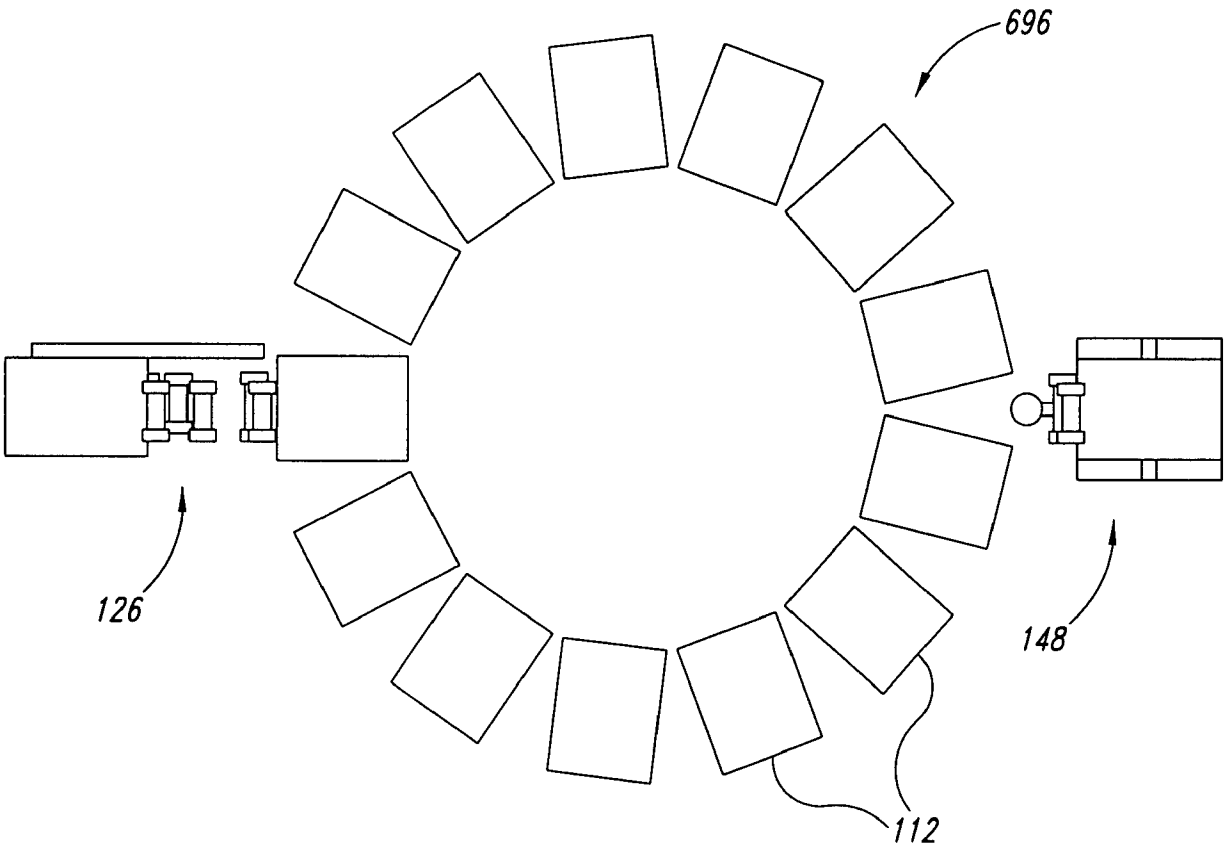
FIG. 20 is a top plan view of a card distribution device of FIGS. 18 and 19.

FIG. 17 shows a label maker 850 to make the labels 804 using a media supply 852. The media supply 852 may include a number of precut labels 804 that include a pressure sensitive adhesive. The labels 804 may be carried on a release liner 854, which may be supplied in the form of a roll.

The label maker 850 may include a printhead 856, for example a thermal printhead, dot matrix printhead or impact printhead, for forming machine-readable symbols 802 and/or human-readable symbols (not show) on the label-804. The print head 856 may be spaced across a media path 858 from a platen roller 860, as is conventionally known in the printing arts.

The label maker 850 may additionally, or alternatively, include an antenna 861 for wirelessly transmitting information to be encoded in the semiconductor device 820 of the label 804, as is conventionally known in the RFID arts.

The label maker 850 may include a printed circuit board 862 carrying a microprocessor 864, memory such as random access memory (RAM) 866 and/or read only memory (ROM) 868, a print driver and/or motor controller 870, and a transmitter or transceiver 872. The RAM 866 and/or ROM 868 store instructions and/or data executable by the microprocessor 864 to print the machine-readable symbol 802 on the label 804 and to wirelessly transmit information to be stored in the semiconductor device 820. The print driver and/or motor controller 870 provides print signals to the printhead 856 and motor control signals to coordinate the movement of the media along the media path 858 with the printing. A motor (not shown) may drive the platen roller 860, so some other media transport device to advance the media along the media path 858. The transmitter or transceiver 872 provides appropriate signals to the RF antenna 861.

Review of General Concepts

While the embodiments of FIGS. 7-17 are discussed with respect to the standalone embodiment of the playing card shuffling device 24*a*, the processing may be distributed to other computing systems and/or processors distributed throughout a casino, or associated with one or more of the gaming tables 18.

Distributing the processing may reduce the workload on the microprocessor 154 of the playing card shuffling device 24*b*, allowing a smaller, less costly processor to be employed. For example, random number generation may be performed by one or more "central" (i.e., common to at least two playing card shuffling devices) processors, potential reducing the number of microprocessors or ASIC in the playing card shuffling device 24*b*. This may be economically significant when one realizes the potential number of individual playing card shuffling device 24*a* required to cover an entire casino. Additionally, concentrating some of the processing in one or more "central" processors may provide better control over the software, and may make changes to the software simpler. In contrast, retaining processing at the playing card shuffling device 24*a* may provide faster operation, and may allow simple installation without the need for installation and maintenance of costly networks. The above described systems may also employ a mix of the above approaches, for example, retaining processing at the playing card shuffling device 24*a* for some aspects such as operating the input and output transport mechanisms 118, 120, while distributing the processing to host computing system 12 for other aspects such as random number generation. This may be particularly advantageous for implementing progressive jackpots or bonuses with card games.

Automatic shuffling according to a pseudo-random sequence may realize a number of distinct advantages over mechanical shufflers. For example, the playing card shuffling devices 24*a*, 24*b*, 24*c* can employ an unlimited number of "virtual" card decks (i.e., playing card values) in creating the random playing card sequence, only distributing the limited number of physical playing cards required for playing a game. For example, the playing card shuffling device 24*a*, 24*b*, 24*c* can receive or generate, respectively, the random playing card sequence from 500 decks of cards or more, yet distribute only one or two decks of playing cards, or as few hands of playing cards, as needed. The playing card shuffling device 24*a*, 24*b*, 24*c* may also produce a more truly random sequence than a mechanical shuffler, which is prone to incomplete shuffling due to the inherent consistencies of mechanical systems. The card shuffling devices 24*a*, 24*b*, 24*c* may also increase the speed of play since the card shuffling devices 24*a*, 24*b*, 24*c* eliminate the need for repeated mechanical manipulations of the playing cards.

Automatic shuffling according to a non-pseudo-random or partially pseudo-random sequence may realize a number of distinct advantages over mechanical shufflers. For example, the playing card shuffling devices 24*a*, 24*b*, 24*c* can provide for jackpot or enhanced payouts at a know probability or within a desired range of probabilities. Additionally, or alternatively, the playing card shuffling devices 24*a*, 24*b*, 24*c* can provide for progressive payouts at a known probability, enhancing the ability to bring progressive type gaming to table games.

Thus, the card shuffling devices 24*a*, 24*b*, 24*c* may provide a variety of functions. For example, the card shuffling devices 24*a*, 24*b*, 24*c* may function as a discard reader, where as the discards (e.g., playing cards collected from participants at end of game) are feed into the receiver 102, each playing card will be transported and read to determine the rank, suit and proper identification number. The "hit" cards can therefore be determined according to methods discussed in previous commonly assigned applications.

Also for example, the card shuffling devices 24*a*, 24*b*, 24*c* may function as deck checker, where new decks will be placed in the same receptacle 102 and read prior to use for verification the correct number of cards and ID are present.

Also for example, the card shuffling devices 24*a*, 24*b*, 24*c* may function as card distribution device, where software controls will automatically determine a random sequence of cards for game play. The operator can select single or multiple decks for play through a software interface. This sequence is not governed by mechanical means and therefore is a true virtual sequence created by software and physically assembled through individual card selection. This is very different from conventional mechanical shufflers since the card distribution, or randomness, is theoretically perfect and not based on achieving a good shuffle based completely on mechanical manipulation. Shuffle machines have a history of not being random which has led to many occurrences where individual's video and figure out the un-randomness of the machine to predict the cards sequence. Shuffle tracking techniques and card "clumping" (tracking the last rounds played and following certain "clumps" of cards as they are shuffled and find there way back into the next deck) is a common problem of shufflers. The subject card shuffling devices 24*a*, 24*b*, 24*c* reduces or even eliminates this problem.

Also for example, the card shuffling devices 24*a*, 24*b*, 24*c* may function to set virtual odds. The subject the card shuffling devices 24*a*, 24*b*, 24*c* allow the operator to select a random generation of cards from any number of virtual decks. The result may be a single or multi-deck shoe that includes playing cards picked from any number (e.g., 100 decks) to achieve a programmable theoretical odds to the game.

Although specific embodiments of and examples for the card distribution device and method of operating the same are described herein for illustrative purposes, various equivalent modifications can be made without departing from the spirit and scope of the invention, as will be recognized by those skilled in the relevant art. The teachings provided herein of the invention can be applied to any networked systems, including the World Wide Web portion of the Internet. The teachings can also employ standalone systems, and/or to combinations of standalone and networked card distribution devices 24 in the same gaming environment. The teachings can apply to any type of card game where a random distribution of playing cards is desired, such as baccarat, 5-card stud poker, Caribbean stud poker, Tai Gow poker, Hi/Low, and Let-It-Ride™. While the illustrated embodiments show networked and standalone embodiments, the invention is not limited to such, and one skilled in the art can easily adapt the teachings herein to further levels of wagering. The card distribution device 24 can be used with a larger number of players. The card distribution device 24 can be used in environments other than casinos, such as taverns, betting parlors, and even homes. Additionally, the methods described above may include additional steps, omit some steps, and perform some steps in a different order than illustrated.

The various embodiments described above can be combined to provide further embodiments. All of the above U.S. patents, patent applications and publications referred to in this specification as well as commonly assigned Application Nos.: No. 60/130,368, filed Apr. 21, 1999; Ser. No. 09/474,858, filed Dec. 30, 1999, entitled "METHOD AND APPARATUS FOR MONITORING CASINOS AND GAMING"; No. 60/259,658, filed Jan. 4, 2001; Ser. No. 09/849,456, filed May 4, 2001, entitled "METHOD, APPARATUS AND ARTICLE FOR VERIFYING CARD GAMES, SUCH AS BLACKJACK"; Ser. No. 09/790,480, filed Feb. 21, 2001, entitled "METHOD, APPARATUS AND ARTICLE FOR EVALUATING CARD GAMES, SUCH AS BLACKJACK"; No. 60/300,253, filed Jun. 21, 2001, entitled "METHOD, APPARATUS AND ARTICLE FOR HIERARCHICAL WAGERING"; Ser. No. 10/061,636, filed Feb. 1, 2002; 60/296,866, filed Jun. 8, 2001, entitled "METHOD, APPARATUS AND ARTICLE FOR RANDOM SEQUENCE GENERATION AND PLAYING CARD DISTRIBUTION"; Ser. No. 10/017,276, filed Dec. 13, 2001, entitled "METHOD, APPARATUS AND ARTICLE FOR RANDOM SEQUENCE GENERATION AND PLAYING CARD DISTRIBUTION"; Ser. No. 10/017,277, filed Dec. 13, 2001, entitled "METHOD, APPARATUS AND ARTICLE FOR VERIFYING CARD GAMES, SUCH AS PLAYING CARD DISTRIBUTION"; No. 60/509,802, filed Oct. 8, 2003, entitled "METHOD, APPARATUS AND ARTICLE FOR RANDOM SEQUENCE GENERATION AND PLAYING CARD DISTRIBUTION,"; and No. 60/543,856, filed Feb. 10, 2004, entitled "METHOD, APPARATUS AND ARTICLE FOR RANDOM SEQUENCE GENERATION AND PLAYING CARD DISTRIBUTION," are incorporated herein by reference. Aspects of the invention can be modified, if necessary, to employ systems, circuits and concepts of the various patents, applications and publications to provide yet further embodiments of the invention.

While the illustrated embodiment typically discusses decks of playing cards, some embodiments may employ a lesser or greater number of playing cards, or can employ playing cards and/or decks other than the conventional playing card decks (i.e., 52 cards with ranks 2-10, Jack, Queen, King, and Ace, and with four suits, hearts, diamonds, spades and clubs).

While generally discussed with respect to ordering playing cards into holders according to rank and suit, other embodiments may order cards into card holders based only on rank. Alternatively, the playing cards may be ordered into one or more card holders according to a computationally generated sequence (e.g., pseudo-random, non-pseudo-random, partially pseudo-random), and then simply release from the card holder(s) in the order in which they were loaded. Other alternatives of distributing playing cards in a computationally generated sequence or order will become apparent from the above teachings to those skilled in the art, whether placed in the computationally generated sequence upon receipt or upon distribution. Further, while generally discussed in terms of a computationally generated pseudo-random sequence, some embodiments may employ other sequences that are not computationally generated pseudo-random sequences, but rather are selected or defined.

These and other changes can be made to the invention in light of the above detailed description. In general, in the following claims, the terms used should not be construed to limit the invention to the specific embodiments disclosed in the specification and the claims, but should be construed to include all card distribution devices and methods that operate in accordance with the claims. Accordingly, the invention is not limited by the disclosure, but instead its scope is to be determined entirely by the following claims.

The invention claimed is:

1. A method of arranging a plurality of playing cards in preparation for a playing card game, each playing card of the plurality of playing cards having a respective rank of a set of ranks and a respective suit of a set of suits and each playing card of the plurality of playing cards associated with a respective playing card value of a set of playing card values, the method comprising:

computationally generating a pseudo-random sequence of playing card values from a set of playing card values, each of the playing card values corresponding to at least one of a respective rank of the set of ranks or a respective suit of the set of suits;

for each playing card in the plurality of playing cards, sorting a respective playing card of the plurality of playing cards into a respective sorted-card holder of a number of sorted-card holders independent of the pseudo-random sequence of playing card values and by at least one of the respective rank or the respective suit of the respective playing card, wherein each respective playing card sorted into a respective sorted-card holder of the number of sorted-card holders has at least one of the identical rank or the identical suit of another playing card, if any, sorted into the respective sorted-card holder of the number of sorted-card holders; and for multiple playing cards, sequentially removing a respective playing card from a respective sorted-card holder in accordance with the generated pseudo-random sequence of playing card values based on at least on one of the respective rank or the respective suit of the respective playing card in an order, wherein a sequence of the playing card values associated with the multiple removed playing cards corresponds to the order in which the multiple removed playing cards were removed from the sorted-card holders, and the sequence of the playing card values associated with the multiple removed playing cards matches at least a portion of the generated pseudo-random sequence of playing card values.

2. The method of claim 1 wherein computationally generating a pseudo-random playing card sequence from a first set of playing card values includes executing a pseudo-random number generation algorithm on a processor.

3. The method of claim 1, further comprising:

reading at least one of the respective rank or the respective suit of a respective playing card of the plurality of playing cards with a card reader before sorting the respective playing card into one of the sorted-card holders.

4. The method of claim 1 wherein sorting a respective playing card of the plurality of playing cards into a respective sorted-card holder of a number of sorted-card holders by at least one of the respective rank or the respective suit of the respective playing card includes sorting playing cards of identical rank into respective ones of the sorted-card holders.

5. The method of claim 1 wherein sorting a respective playing card of the plurality of playing cards into a respective sorted-card holder of a number of sorted-card holders by at least one of the respective rank or the respective suit of the respective playing card includes sorting playing cards of identical rank and suit into respective ones of the sorted-card holders.

6. The method of claim 1 wherein sorting a respective playing card of the plurality of playing cards into a respective sorted-card holder of a number of sorted-card holders by at least one of the respective rank or the respective suit of the respective playing card includes sorting playing cards of identical suit into respective ones of the sorted-card holders.

7. The method of claim 1, further comprising:

determining whether a respective playing card of the plurality of playing cards bears an illicit marking; and directing each respective playing card bearing an illicit marking to an alternate card holder.

8. The method of claim 1, further comprising:

directing damaged playing cards to an alternate card holder.

9. The method of claim 1, further comprising:

for each of the sorted-card holders, determining a quantity playing cards that are received in the respective sorted-card holders before removing the number of playing cards from the sorted-card holders.

10. The method of claim 1 wherein computationally generating a pseudo-random sequence of playing card values from a set of playing card values includes determining a respective playing card value for each playing card in at least one deck, wherein one deck is comprised of at least fifty-two playing cards.

11. The method of claim 1 wherein computationally generating a pseudo-random sequence of playing card values from a set of playing card values includes determining a respective playing card value for each playing card in at least eight decks, wherein each deck is comprised of at least fifty-two playing cards.

12. The method of claim 1 wherein computationally generating a pseudo-random sequence of playing card values from a set of playing card values includes selecting a number of playing cards to be used in the generated sequence to achieve a theoretical win/loss threshold associated with a playing card game.

13. The method of claim 1 wherein removing a number of sorted playing cards from the sorted-card holders includes removing a quantity of playing cards that is less than the plurality of playing cards.

14. A playing card delivery device, comprising:

a card receiver sized and dimensioned to receive a plurality of playing cards, wherein each playing card of the plurality of playing cards is associated with a respective playing card value of a set of playing card values;

a plurality of sorted-card holders, wherein each sorted-card holder is configured to receive a number of sorted playing cards;

a card reader to read at least one respective identifier on each respective playing card of the playing cards, the card reader positioned to read the at least one respective identifier on a respective playing card of the plurality of playing cards before the respective playing card is sorted into a respective sorted-card holder of the plurality of sorted-card holders;

a processor programmed to generate a pseudo-random sequence of playing card values from the set of playing card values;

a transport means for sequentially transporting each respective playing card of the plurality of playing cards from the card receiver into a respective sorted-card holder of the plurality of sorted-card holders, wherein the respective playing card is transported into the respective sorted-playing card holder independent of the pseudo-random sequence of playing card values;

a distribution means for distributing the playing cards from the sorted-card holders based on the at least one respective identifier on each one of the playing cards and in accordance with the pseudo-random sequence of playing card values, wherein a sequence of the respective playing card values of the distributed playing cards corresponds to an order in which the distributed playing cards are removed from the sorted-playing card holders and matches at least a portion of the generated pseudo-random sequence of playing card values; and an output receptacle sized and dimensioned to receive the distributed playing cards.

15. The playing card delivery device of claim 14, further comprising:

an alternate card holder to receive a playing card having at least one illicit marking.

16. The playing card delivery device of claim 14, further comprising:

an alternate card holder to receive damaged playing cards.

17. The playing card delivery device of claim 14 wherein the transport means comprises an input conveyer.

18. The playing card delivery device of claim 17 wherein the transport means further comprises an input actuator positioned to transfer each playing card from the input conveyor to one of the respective sorted-card holders.

19. The playing card delivery device of claim 18 wherein the input actuator is a roller that is driven in response to control signals from a microprocessor.

20. The playing card delivery device of claim 14 wherein the distribution means comprises an output conveyor.

21. The playing card delivery device of claim 14, further comprising:

a counter to determine a quantity of sorted playing cards received by the sorted-card holders.

22. The playing card delivery device of claim 14, further comprising:

a controller programmed to control a position of at least some of the sorted-card holders with respect to the transport means.

23. The playing card delivery device of claim 14 wherein the identifier is a machine-readable symbol.

24. A playing card delivery device, comprising:

a receiving means sized and dimensioned for receiving a plurality of playing cards;

a storage means for at least temporarily storing at least some of the playing cards received from the receiving means, wherein each playing card currently stored in the storage means is sorted;

a reading means for reading at least one identifier on each of the playing cards that is provided to the storage means, the reading means positioned to read a respective identifier on a respective playing card before the respective playing card is sorted into the storage means;

a computing means for generating a pseudo-random playing card sequence from a set of playing card values;

a sorting means for sorting independent of the pseudo-random playing card sequence at least some of the playing cards received from the receiving means into the storage means based at least on the respective at least one identifier on each respective playing card;

a transport means for sequentially transporting each playing card from the receiving means to the storage means;

a distribution means for sequentially distributing the playing cards, one by one, from the storage means based on the identifier on the playing cards and in an order corresponding to the generated pseudo-random sequence of playing card values; and an output means sized and dimensioned for receiving the distributed playing cards.

25. The playing card delivery device of claim 24, further comprising:

a secondary storage means for receiving a playing card having at least one illicit marking.

26. The playing card delivery device of claim 24, further comprising:

a secondary storage means for receiving damaged playing cards.

27. The playing card delivery device of claim 24 wherein the transport means comprises an input conveyer.

28. The playing card delivery device of claim 27 wherein the transport means further comprises an input actuator positioned to remove each playing card from the input conveyor to the storage means.

29. The playing card delivery device of claim 28 wherein the input actuator is a roller that is driven in response to control signals from a microprocessor.

30. The playing card delivery device of claim 24 wherein the distribution means comprises an output conveyer.

31. The playing card delivery device of claim 24, further comprising:

a counting means for determining a quantity of the playing cards received by the storage means.

32. The playing card delivery device of claim 24 wherein the sorting means includes a positioning means for substantially aligning a portion of the storage means to receive at least one of the playing cards from the transport means.

33. The playing card delivery device of claim 24 wherein the respective identifier on the respective playing card is a machine-readable symbol.

34. The playing card delivery device of claim 24 wherein the respective identifier on the respective playing card is at least one of a rank or a suit.

35. A playing card delivery device, comprising:

a processor programmed to generate a pseudo-random sequence of playing card values from a set of playing card values;

a card receiver sized and dimensioned to receive a plurality of playing cards, wherein each playing card of the plurality of playing cards is associated with a respective playing card value and has a respective identifier thereon;

a plurality of sorted-card holders, each sorted-card holder sized and dimensioned to receive a number of playing cards;

a card reader to read the respective identifier on a respective playing card of the plurality playing cards received by the card reader, the card reader positioned to read the respective playing card before the respective playing card is received by a respective sorted-card holder of the plurality of sorted-card holders;

a transport means for sequentially transporting independent of the generated pseudo-random playing card value sequence each respective playing card of the plurality of playing cards received by the card receiver from the card receiver to a respective sorted-card holder of the plurality of sorted-card holders based at least on the respective identifier on the respective playing card such that each playing card of the number of playing cards received by the respective sorted-card holder of the plurality card holders is associated with the same playing card value;

a distribution means for sequentially distributing a number of playing cards, one by one, from a number sorted-card holders in a sequence of playing card values associated with each respective playing card of the number playing cards in the sequence of the distributed playing cards such that the generated pseudo-random sequence of playing card values corresponds to the sequence of playing card values associated with each respective playing card of the number playing cards in the sequence of the distributed playing cards; and an output receptacle sized and dimensioned to concurrently receive the sequence of distributed playing cards.

36. A playing card delivery device, comprising:

a receiving means sized and dimensioned for receiving a plurality of playing cards, wherein each playing card of the plurality of playing cards is associated with a respective playing card value and has a respective identifier thereon;

a storage means for at least temporarily storing at least some of the playing cards received from the receiving means, wherein each playing card currently stored in the storage means is sorted;

a reading means for reading the respective identifier on each respective playing card of the plurality of playing cards received by the receiving means, the reading means positioned to read the respective identifier on the respective playing card of the plurality of playing cards before the respective playing card is sorted into the storage means based at least upon the respective identifier and the respective playing card value associated with the respective playing card;

a sorting means for sorting at least some of the playing cards received from the receiving means into the storage means based at least on the respective identifier on each respective playing card;

a transport means for sequentially transporting each playing card from the receiving means to the storage means;

a computing means for generating a pseudo-random sequence of playing card values from a set of playing card values;

a distribution means for sequentially removing and distributing a number of playing cards, one by one, from a number card holders in a sequence of playing card values associated with each respective playing card of the number playing cards in the sequence of the distributed playing cards such that the generated pseudo-random sequence of playing card values corresponds to the sequence of playing card values associated with each respective playing card of the number playing cards in the sequence of the distributed playing cards; and an output means sized and dimensioned for receiving playing cards, the output means receives each one of the sequence of distributed playing cards.

37. The method of claim 1, further comprising:

providing each one of the removed playing cards to a common outlet to an exterior of a playing card delivery device.

38. The playing card delivery device of claim 14 wherein the output receptacle is configured to provide each one of the distributed playing cards to an exterior of the playing card delivery device.

39. The playing card delivery device of claim 24 wherein the output means is configured to provide each one of the distributed playing cards to an exterior of the playing card delivery device.

40. A method of arranging a plurality of playing cards in preparation for a playing card game, the method comprising:

receiving a plurality of playing cards, each playing card of the plurality of playing cards having a respective rank of a set of ranks and a respective suit of a set of suits;

computationally generating a pseudo-random sequence of playing card values from a set of playing card values, each of the playing card values corresponding to at least one of a respective rank of the set of ranks or a respective suit of the set of suits;

for each respective playing card in the plurality of playing cards, sorting, independent of the generated pseudo-random sequence of playing card values, the respective playing card into a respective sorted-card holder of a number of sorted-card holders by at least one of a respective rank or a respective suit of the respective playing card such that for each respective sorted-card holder of the number of sorted-card holders, each playing card sorted into the respective sorted-card holder of the number of sorted-card holders has at least one of an identical rank or an identical suit; and in accordance with the pseudo-random sequence of playing card values and for each respective playing card value in the sequence of playing card values, sequentially removing, one by one, a respective playing card having a respective value matching the respective playing card value of the sequence of playing card values from a respective sorted-card holder of the number of sorted-card holders, wherein the respective value of the respective playing card corresponds to at least one of the respective rank or the respective suit of the respective playing card, and providing the respective playing card to a common outlet to an exterior of a playing card delivery device such that each removed playing card is provided to the common outlet.

* * * * *